US005128652A

United States Patent [19]

Slocum

[11] Patent Number: 5,128,652

[45] Date of Patent: Jul. 7, 1992

[54] FLUID DETECTION SYSTEM WITH SELECTABLE RELAY RELEASE

[75] Inventor: Laurence S. Slocum, Indianapolis, Ind.

[73] Assignee: Emerson Electric Co., St. Louis, Mo.

[21] Appl. No.: 588,022

[22] Filed: Sep. 25, 1990

[51] Int. Cl.[5] ..... G08B 23/00

[52] U.S. Cl. ..... 340/502; 340/517; 340/518; 340/620; 340/612; 73/405 R; 73/DIG. 8; 137/386

[58] Field of Search ..... 340/502, 522, 605, 517, 340/620, 618, 603, 604, 521, 624, 518, 612; 73/40.5 R, 40.7, 61.1 R, 61 R, 49.2, DIG. 8; 364/550, 551.01; 137/386, 392, 393

[56] References Cited

U.S. PATENT DOCUMENTS 4,451,894 5/1984 Dougherty et al. ..... 340/620
4,497,033 1/1985 Hernandez et al. ..... 340/620
4,740,777 4/1988 Slocum et al. ..... 340/605

*Primary Examiner*—Donnie L. Crosland
*Attorney, Agent, or Firm*—Robert F. Meyer

[57] ABSTRACT

A fluid status detection system includes a plurality of probes connected to a controller. The controller includes a microprocessor, a digital memory, relays, and progammed so that selected alarm and relay latching conditions may be stored, and alarms activated and relays latched according to the alarm and latching conditions. The microprocessor is programmed to provide an alarm acknowledgement signal upon the alarm being acknowledged. An operator may select one or more release conditions individually for each relay from a plurality of possible relay release conditions and store the conditions in the memory. The possible relay release conditions include: the condition that the probe signal indicates that the event that caused the alarm has cleared; the condition that the alarm acknowledgment signal has been provided; the condition that the probe signal indicates that the event that caused the alarm has cleared and the the alarm acknowledgment signal has been provided. Upon occurrence of the selected relay release conditions, the system automatically releases the relay.

6 Claims, 24 Drawing Sheets

SWITCH NETWORK TRUTH TABLE

FLUID DETECTION SYSTEM WITH SELECTABLE RELAY RELEASE

BACKGROUND OF THE INVENTION

1. Field of the Invention

The present invention in general relates to fluid detection systems that include a central controller and a plurality of probes remote from the controller for detecting the fluid status at the probe locations, and more particularly to such a system that is programmable.

2. Description of the Prior Art

Fluid detection systems that include a central controller and numerous probes that are controlled by the controller and report on the fluid status at remote probe locations are well known. Typically such systems are used to detect leaks in underground hydrocarbon tanks. U.S. Pat. No. 4,740,777 on an invention of Laurence S. Slocum and Sara M. Mussmann describes a programmable fluid detector in which the operator can select alarm conditions individually for each probe from many possible alarm conditions including probe failure, hydrocarbon present, water present, and the dry condition. The operator can also select relay latching conditions. In the above system when an alarm occurs the associated relay remains latched until the system is turned off, the cause of the alarm is removed, and the system is restarted. It is also known in the art to permit a responsible person to acknowledge an alarm by entering a secret code which allows the alarm to be reset, which deactivates the alarm. In the above systems and all of the prior fluid detectors in the field, the procedure by which an alarm may be deactivated or a relay released is fixed.

SUMMARY OF THE INVENTION

In the discussion herein, the word release is intended to be a broad term that includes deactivation of any type. Relay means is also intended to be a broad term that may include any device that may be set or latched in an activated condition and then released, or deactivated.

It is an object of the invention to provide a fluid detection system that overcomes one or more of the disadvantages of prior art fluid detection systems.

It is a further object to provide the above object in a fluid detection system in which the operator may select the conditions upon which a relay is to be released.

It is still a further object of the invention to provide one or more of the above objects in a fluid detection system in which each relay may be individually programmed to release automatically upon the occurrence of one or more predetermined conditions.

It is another object of the invention to provide a fluid detection system that provides one or more of the above objects and in which a relay may be released if the event that caused the alarm which triggered the relay clears, or if the alarm is acknowledged, or if both the above occur.

The invention provides a fluid status detection system comprising: a controller and a plurality of probes for sensing the status of fluids at probe locations remote from the controller, each of the probes including means for providing a probe signal to the controller indicative of the fluid status at the probe location, the controller including: alarm means for providing an alarm; relay means; activation means responsive to the probe signals for activating the alarm means and latching the relay means; alarm acknowledgment means for permitting an operator to acknowledge an alarm and for providing an alarm acknowledgment signal upon the alarm being acknowledged; storage means for storing relay release conditions; selecting means for permitting an operator to select one or more release conditions individually for each probe from a plurality of possible release conditions and to store the conditions in the means for storing; release means responsive to the probe signals and the alarm acknowledgment signal and communicating with the means for storing for releasing the relay means upon receiving one or more signals corresponding to one or more of the stored release conditions. Preferably, the plurality of possible relay release conditions comprise: the condition that the probe signal indicates that the event that caused the alarm has cleared; and the condition that the alarm acknowledgment signal has been provided. Preferably, the plurality of possible relay release conditions further include that the probe signal indicates that the event that caused the alarm has cleared and the alarm acknowledgment signal has been provided. Preferably, the release means includes a microprocessor and software means for causing the microprocessor to cycle through a loop checking whether a selected release condition has been met and means for causing a delay for a predetermined time each time the loop is cycled. Preferably, the relay means comprises a relay and the alarm acknowledgment means comprises a means for resetting the alarm.

The invention not only provides a fluid detector in which a relay may be released upon receipt of any one of several occurrences, but also increases the effectiveness of the system since the occurrences that will release the relay may be thought out in advance of the alarm occurring and the system programmed to automatically release. Numerous other features, objects and advantages of the invention will become apparent from the following description when read in conjunction with the accompanying drawings.

DESCRIPTION OF THE PREFERRED EMBODIMENT

Figure 1:
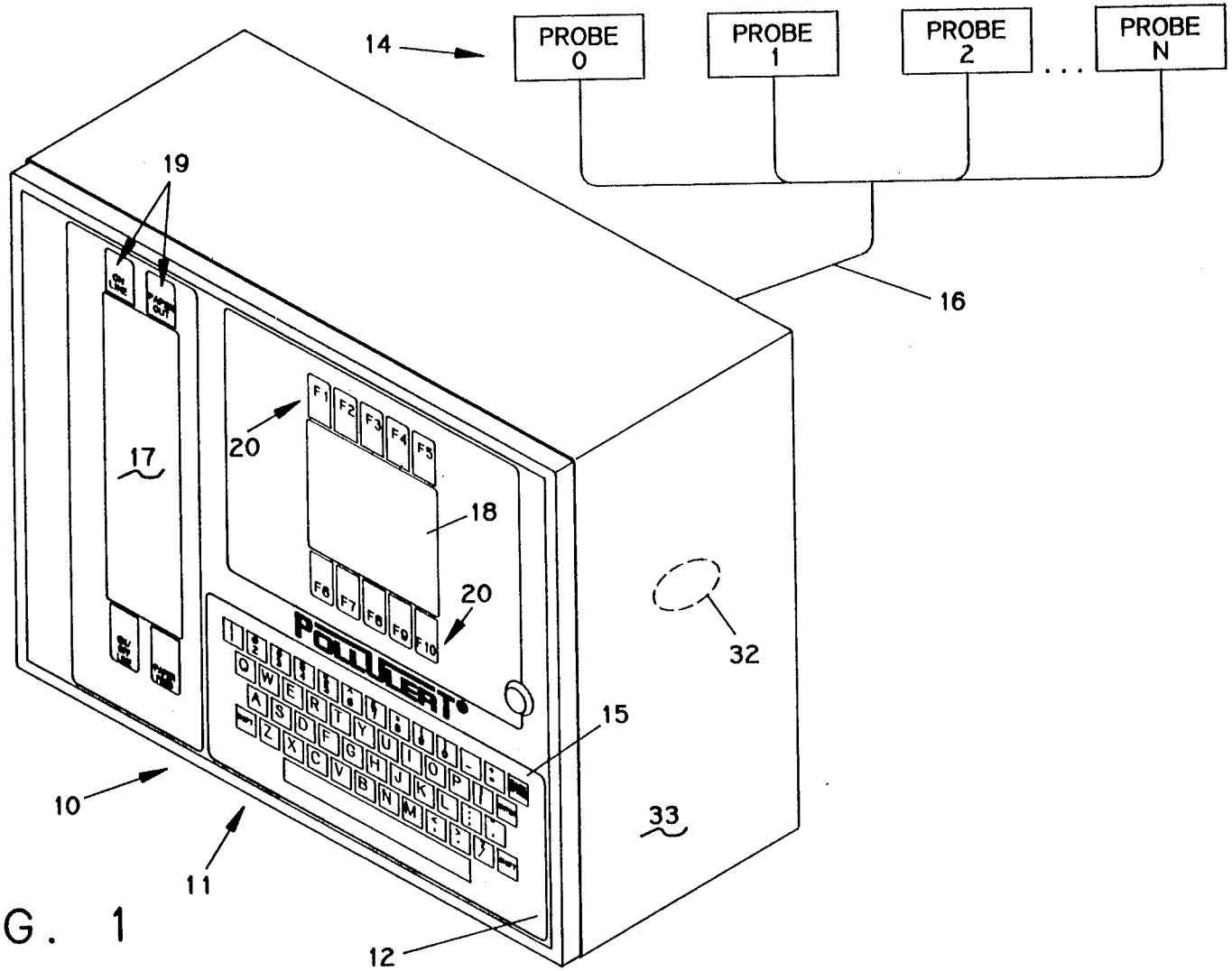
FIG. 1 shows the preferred embodiment of a fluid detection system according to the invention including a perspective view of the controller and a diagrammatic view of n probes.
Figure 4A:
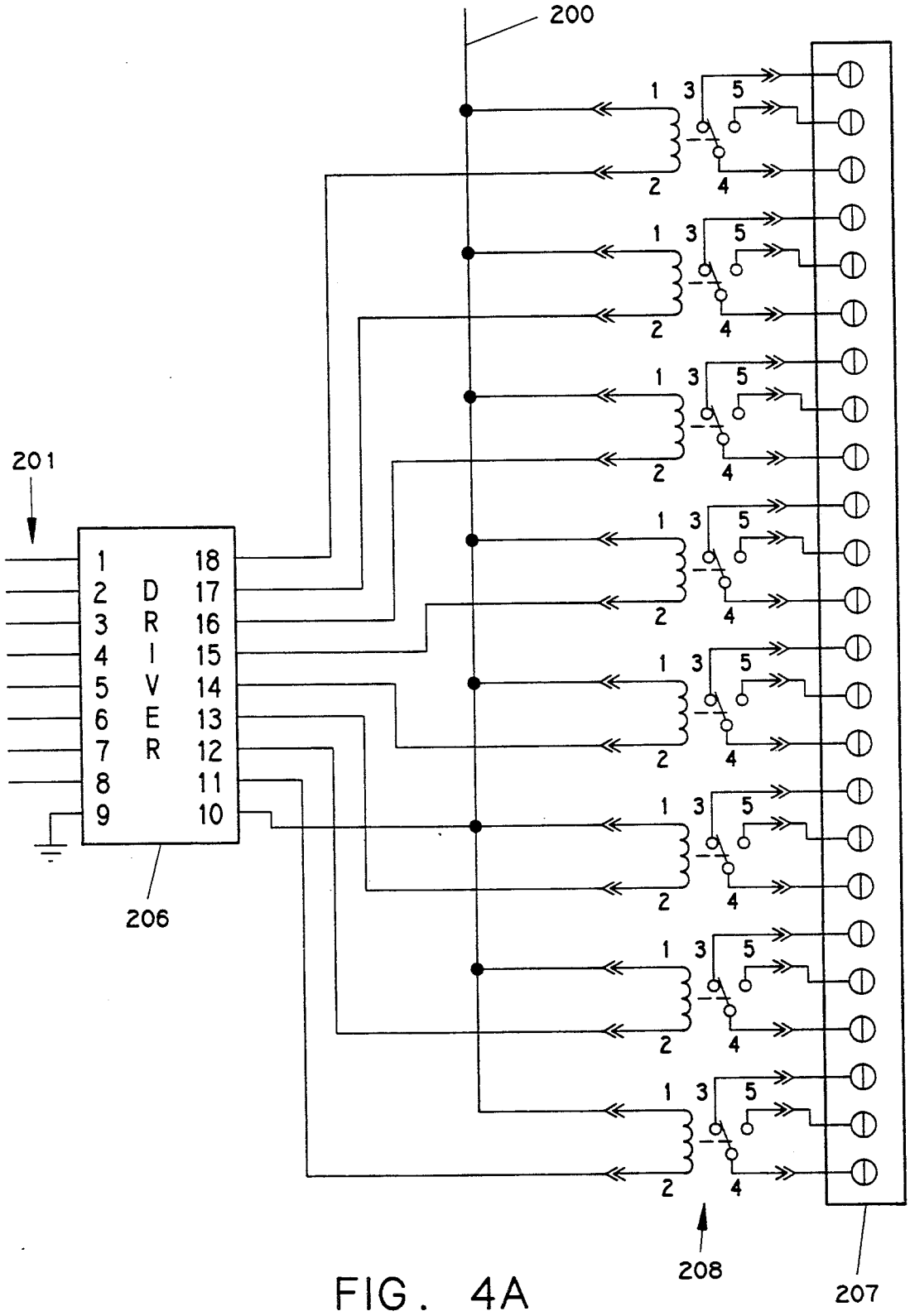
FIGS. 4A through 4E show an electrical circuit diagram of the relay/solid state input circuit board according to the preferred embodiment of the invention.
Figure 4B:
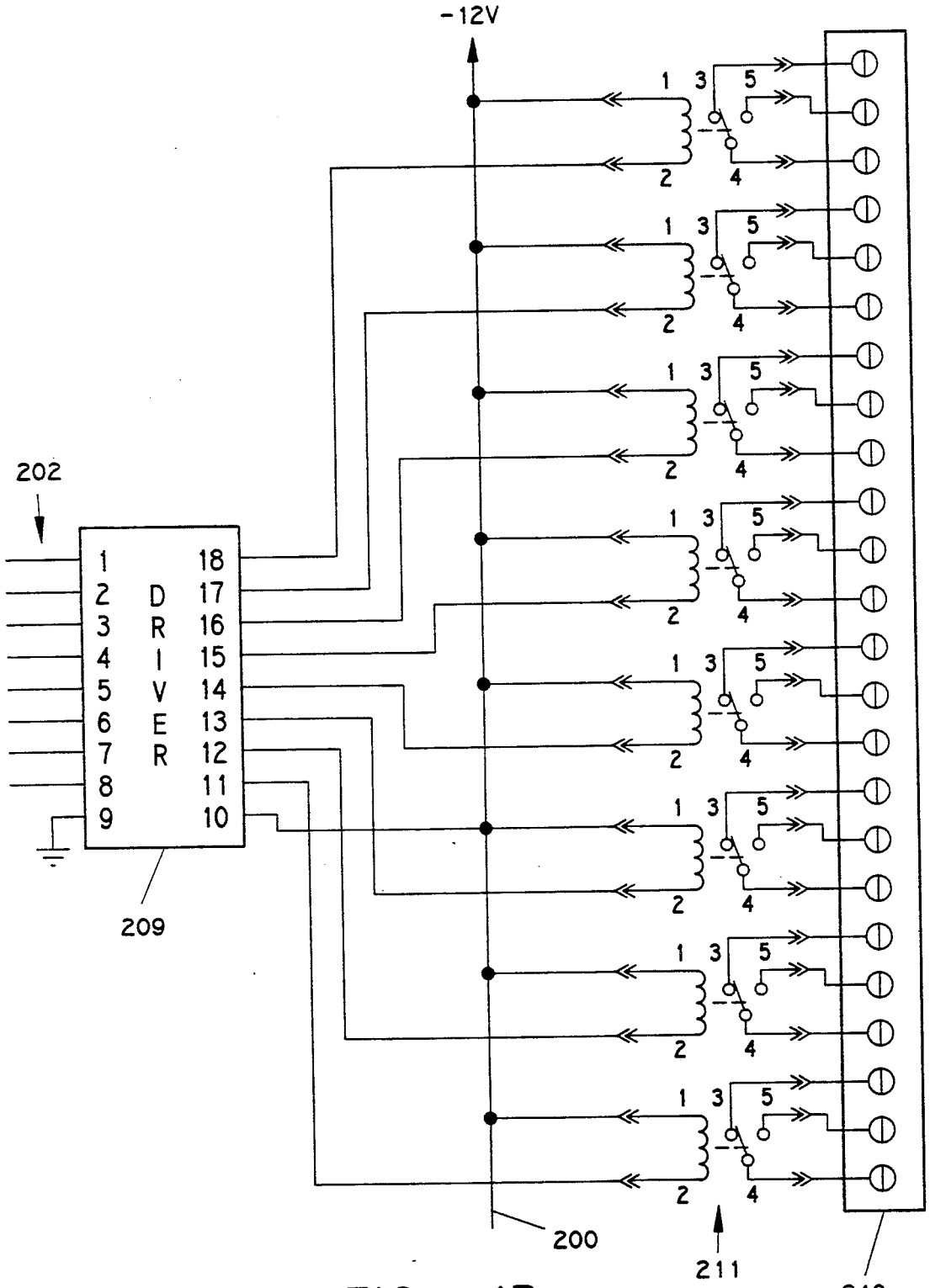
Figure 6:
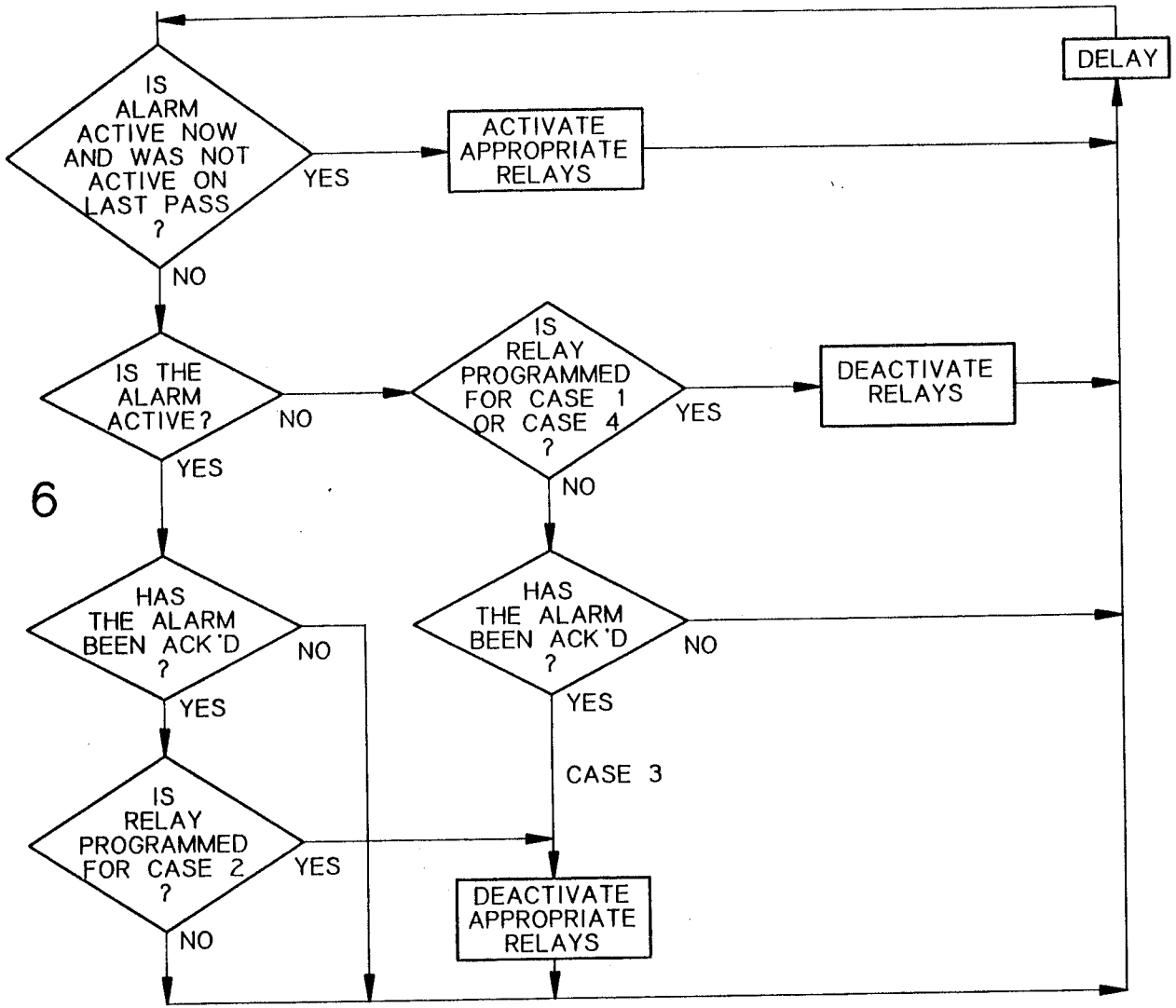
FIG. 6 shows a flow chart describing the preferred embodiment of a software program that automatically releases the relays upon occurrence of the conditions corresponding to the stored relay conditions.
Figure 7:
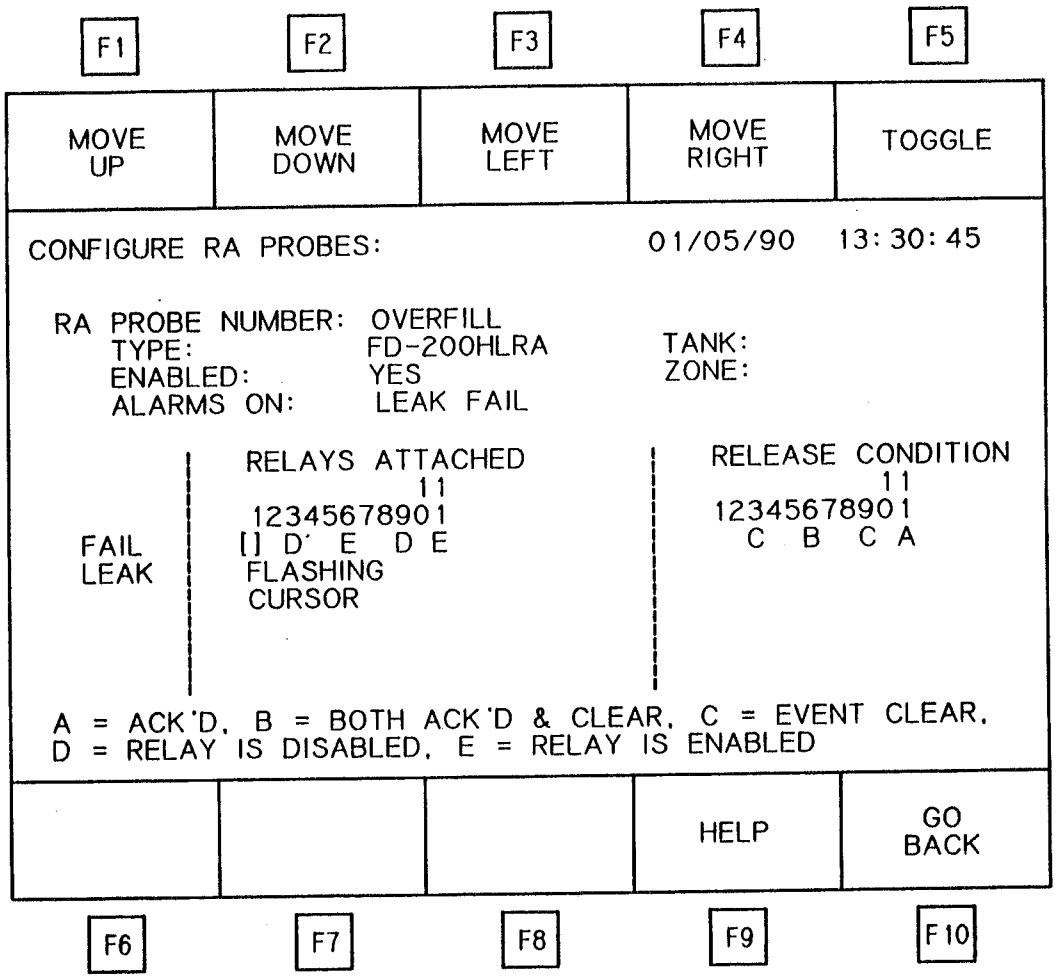
FIG. 7 shows the display and function keys for programming the preferred release conditions.
Figure 8:
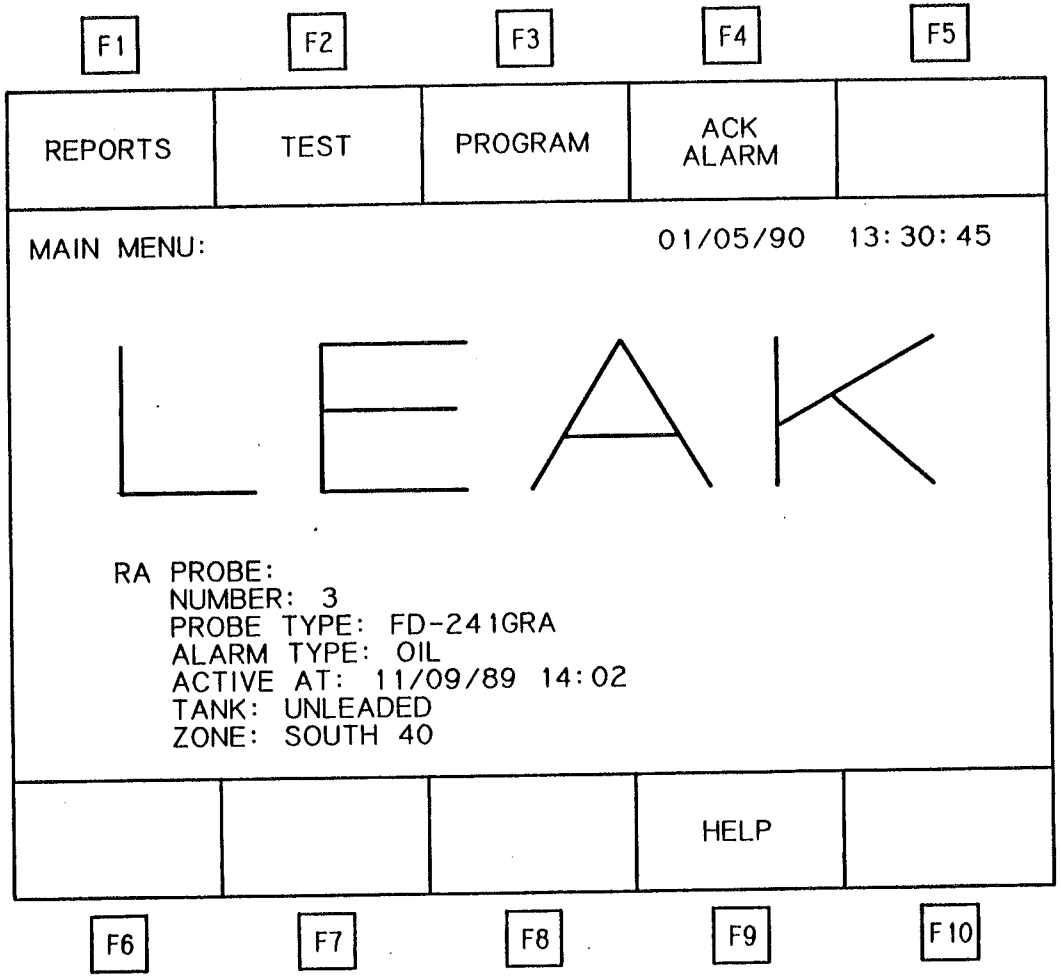
FIG. 8 shows the preferred embodiment of the display screen and function keys for displaying and acknowledging an alarm.

Turning attention to the drawings, FIG. 1 shows the preferred embodiment of a fluid detection system 10 according to the invention. It should be understood that the particular embodiment described below is exemplary of the invention only, and is not intended to limit the invention. The system 10 includes a controller 12 and a multiplicity of probes 14 which are located remotely from the controller 12. Each of the probes 14 is capable of providing a plurality of probe signals to the controller 12 via a cable 16, which signals are indicative of the fluid status at the probe location. See for example U.S. Pat. No. 4,740,777 which is hereby incorporated by reference. The probes 14 will not be discussed in detail herein, and can be any one of a variety of fluid probes, such as those produced by Pollulert Systems, P.O. Box 706, Indianapolis, Ind. 46206. The controller 12 includes a printer 17, display 18, and a keyboard means 11 which includes a full ASCII keyboard 15 and a plurality of key switches 20 adjacent the display; the controller 12 can be operated in both a programming operating mode and a monitoring operating mode. Alarm conditions and latching conditions, which provide the controller with directions on how to respond to probe signals, may be selected by an operator using keyboard means 11, which includes function keys 20. The conditions selected are stored in memory 70 (FIGS. 2C and 2D). When a probe signal is provided, it is processed by central processing unit 24 (FIG. 2F) which uses the stored alarm and latching conditions to activate an alarm and latch a relay means, which may include a display 18 (FIG. 1), LED 19, audio transducer 32, but preferably is or a relay 211 (FIG. 4B). The details of how such a fluid system may be programmed and uses the alarm conditions to activate an alarm and latching conditions to latch a relay is described in U.S. Pat. No. 4,740,777 which is hereby incorporated by reference. At the time of configuring the probes and relays, the condition or conditions under which an individual relay means will be released may also be selected (FIG. 7). When an alarm is activated, it may be acknowledged by entering a secret code and pressing the F4 function key (FIG. 8), which sets an alarm acknowledged flag. The CPU 24 is programmed to automatically release a relay means when the selected conditions are met (FIG. 6), which may be, for example, when both the event that caused the alarm clears and the alarm is acknowledged.

Figure 2A:
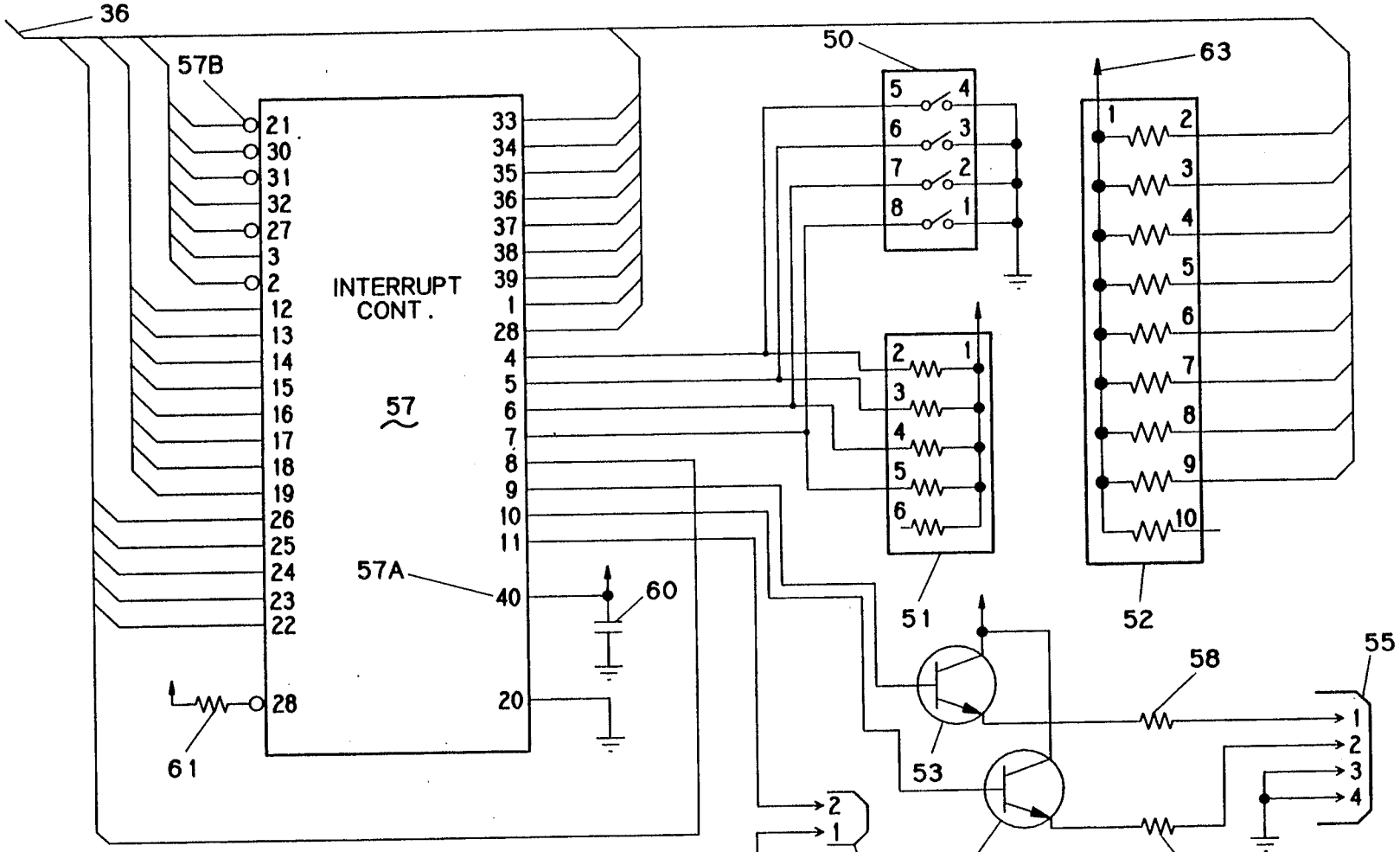
FIGS. 2A through 2H show an electrical circuit diagram of the central processing unit circuit board of the preferred embodiment of a fluid detection system according to the invention.
Figure 2B:
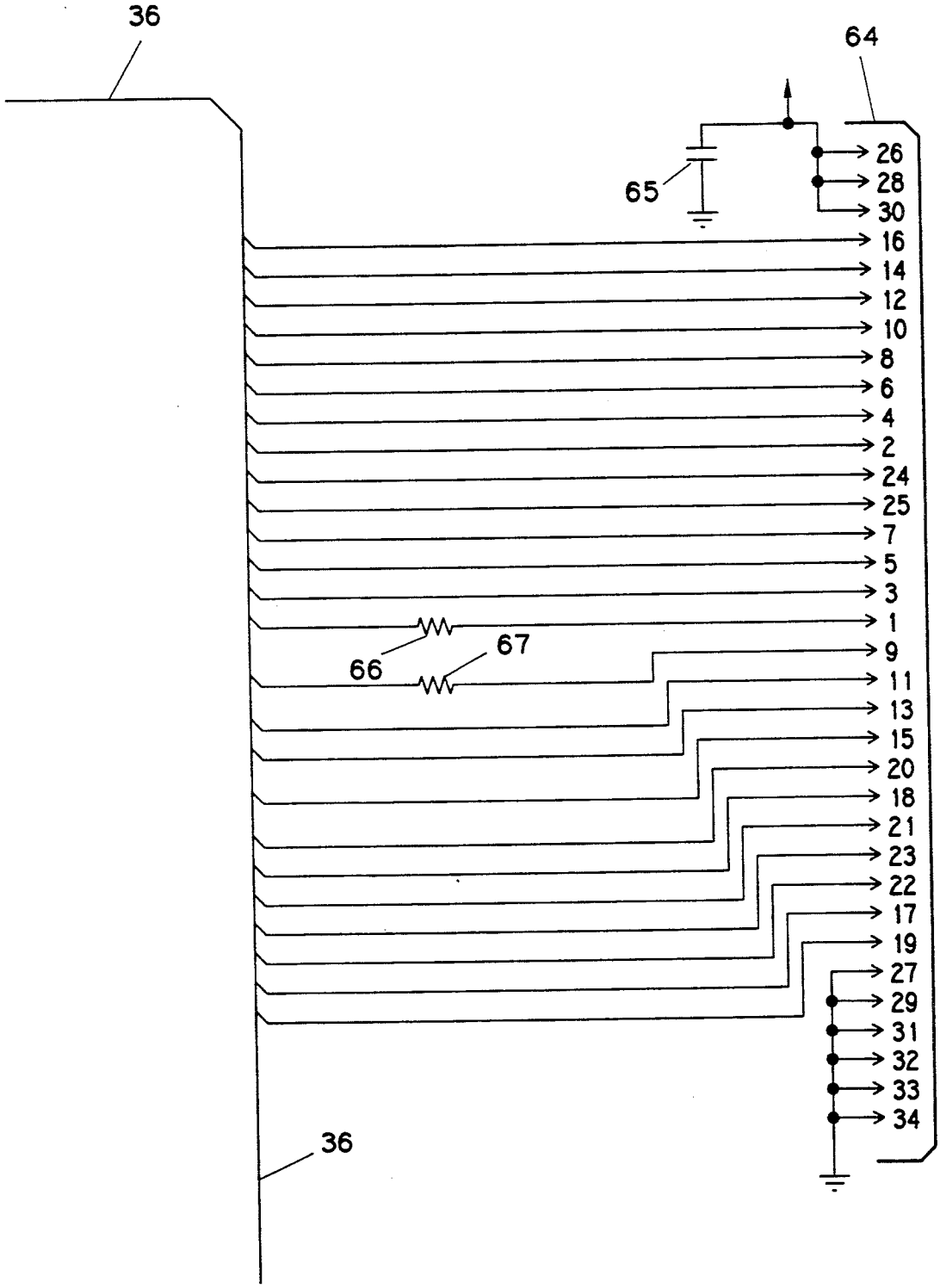
Figure 2C:
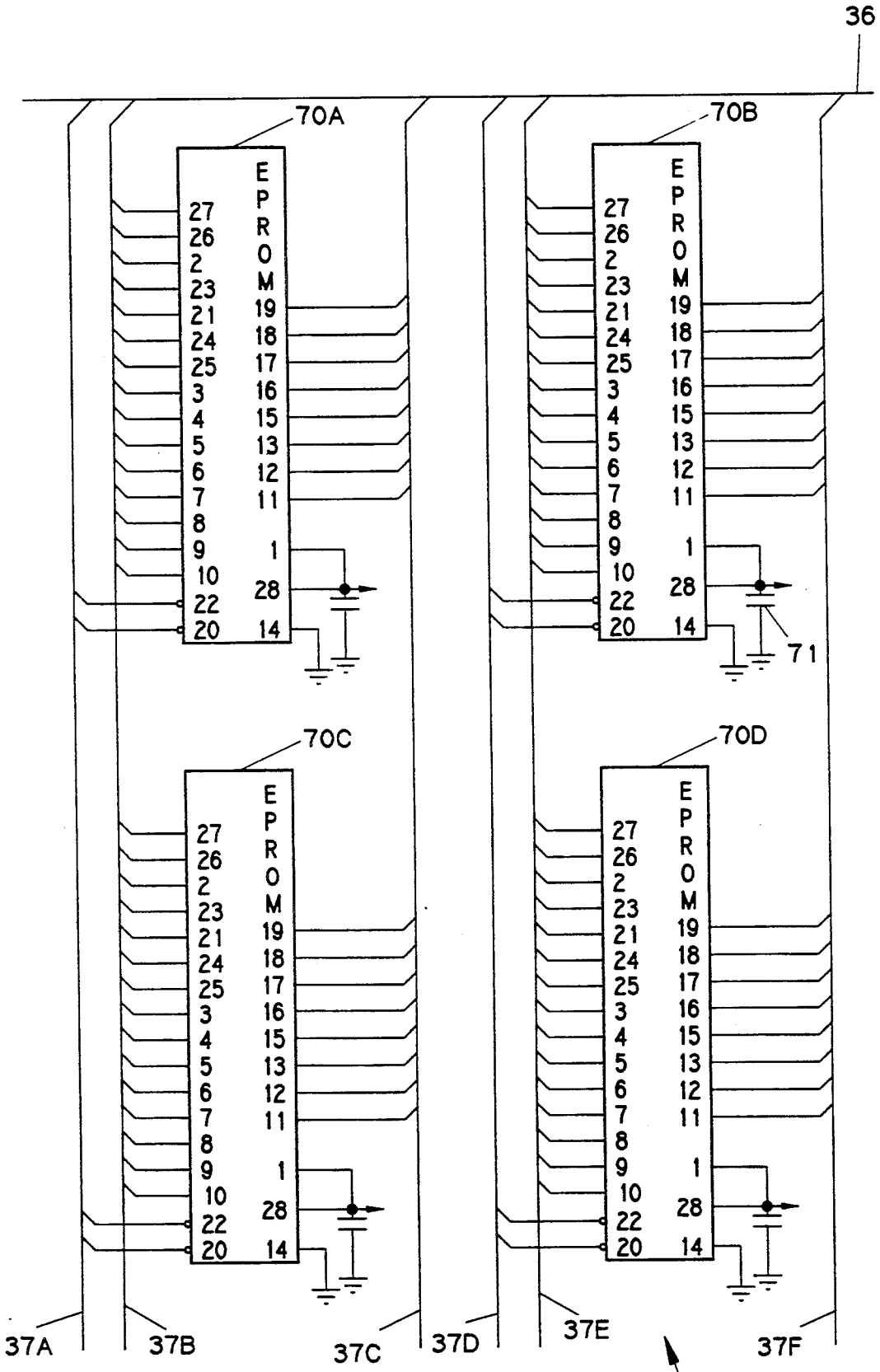
Figure 2D:
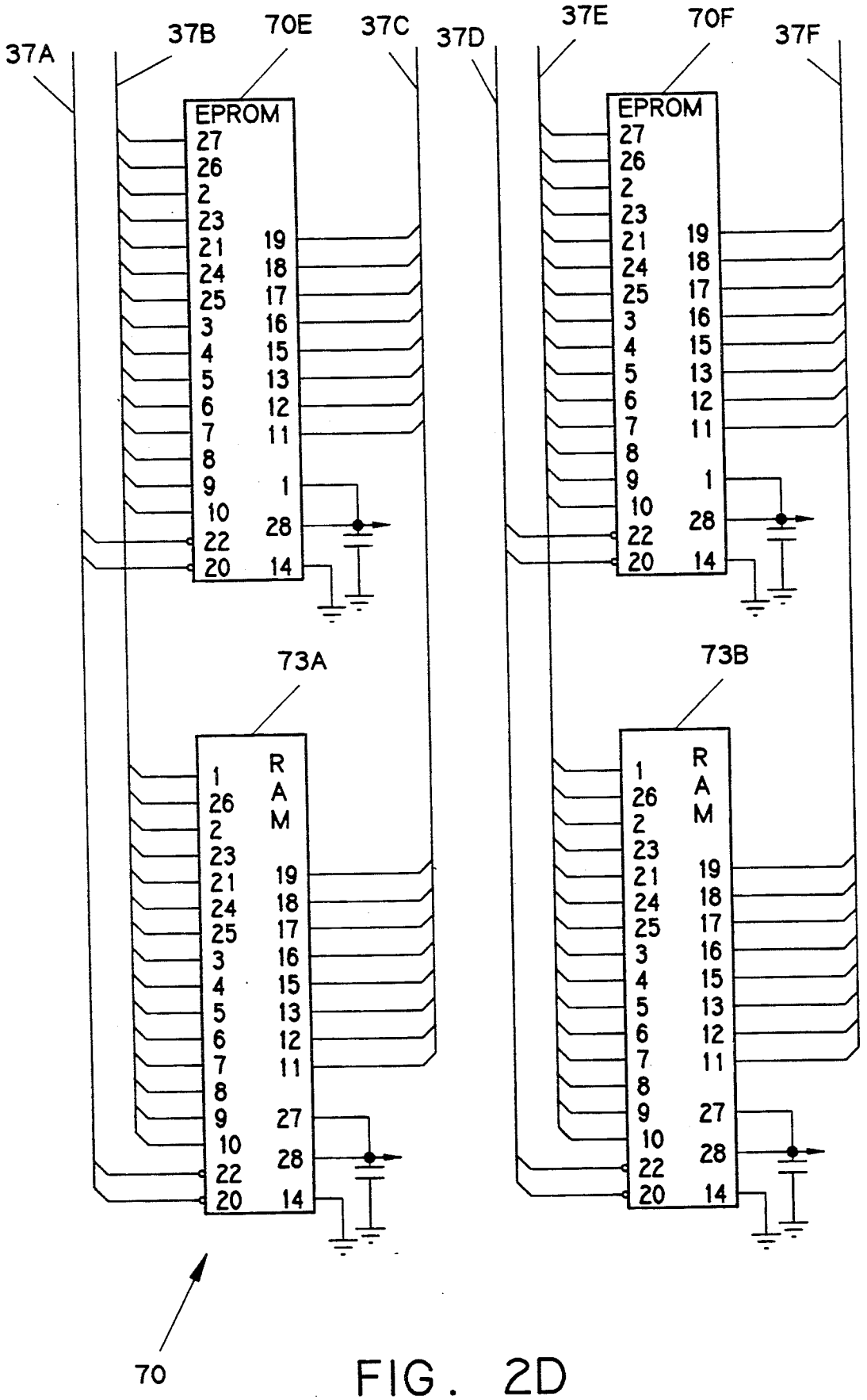
Figure 3A:
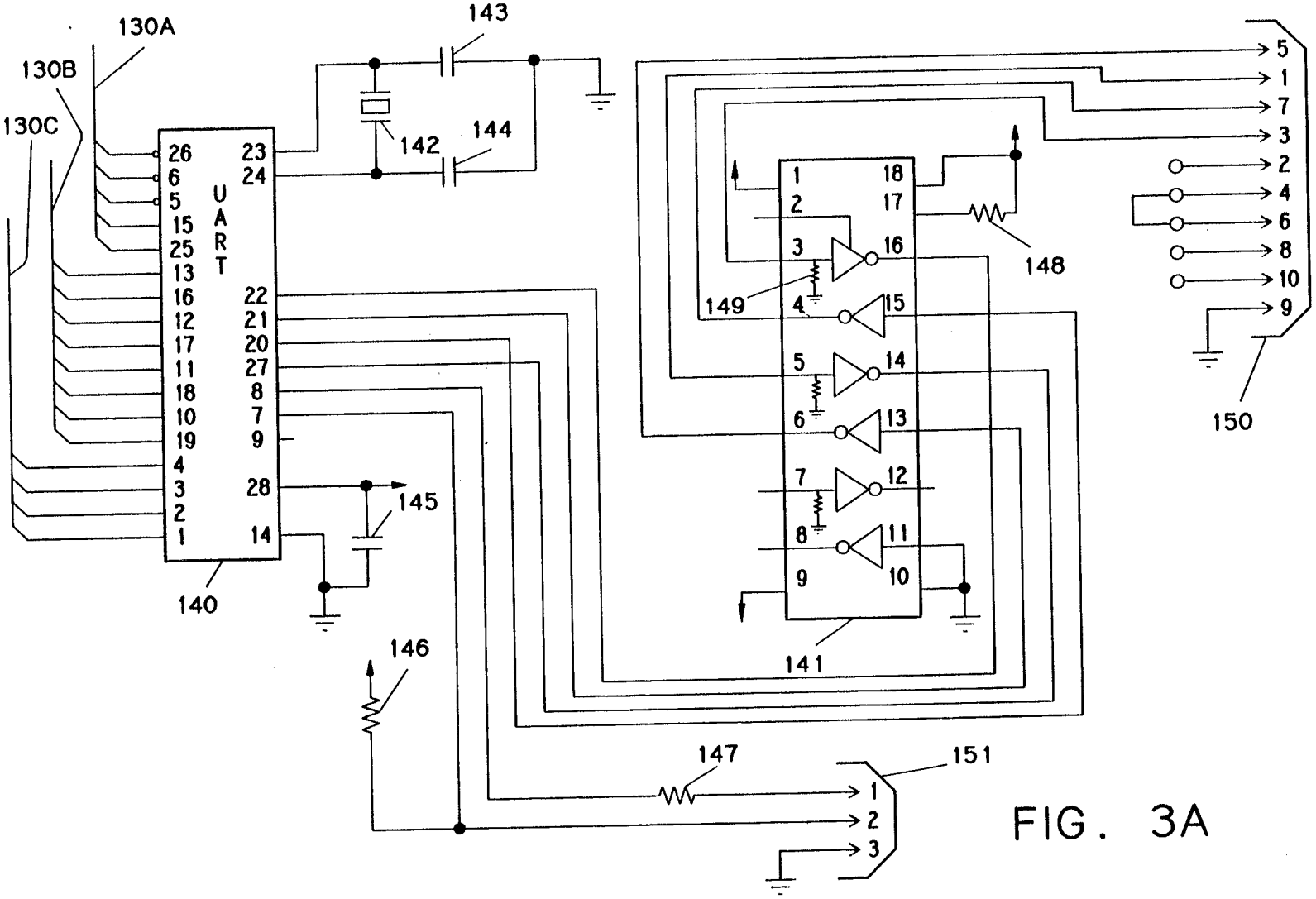
FIGS. 3A through 3F show an electrical circuit diagram of the input/output circuit board according to the preferred embodiment of the invention.
Figure 3B:
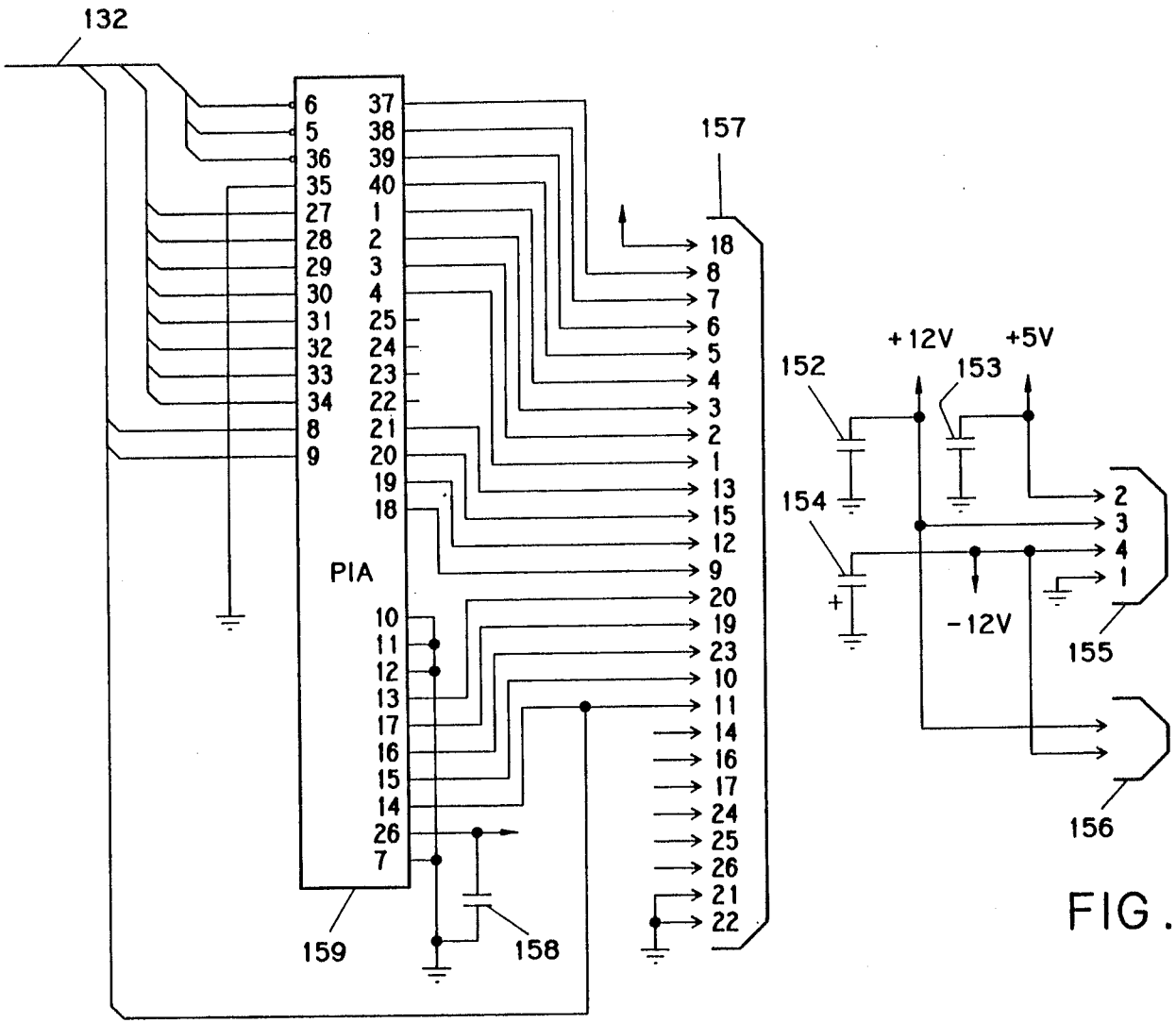
Figure 3C:
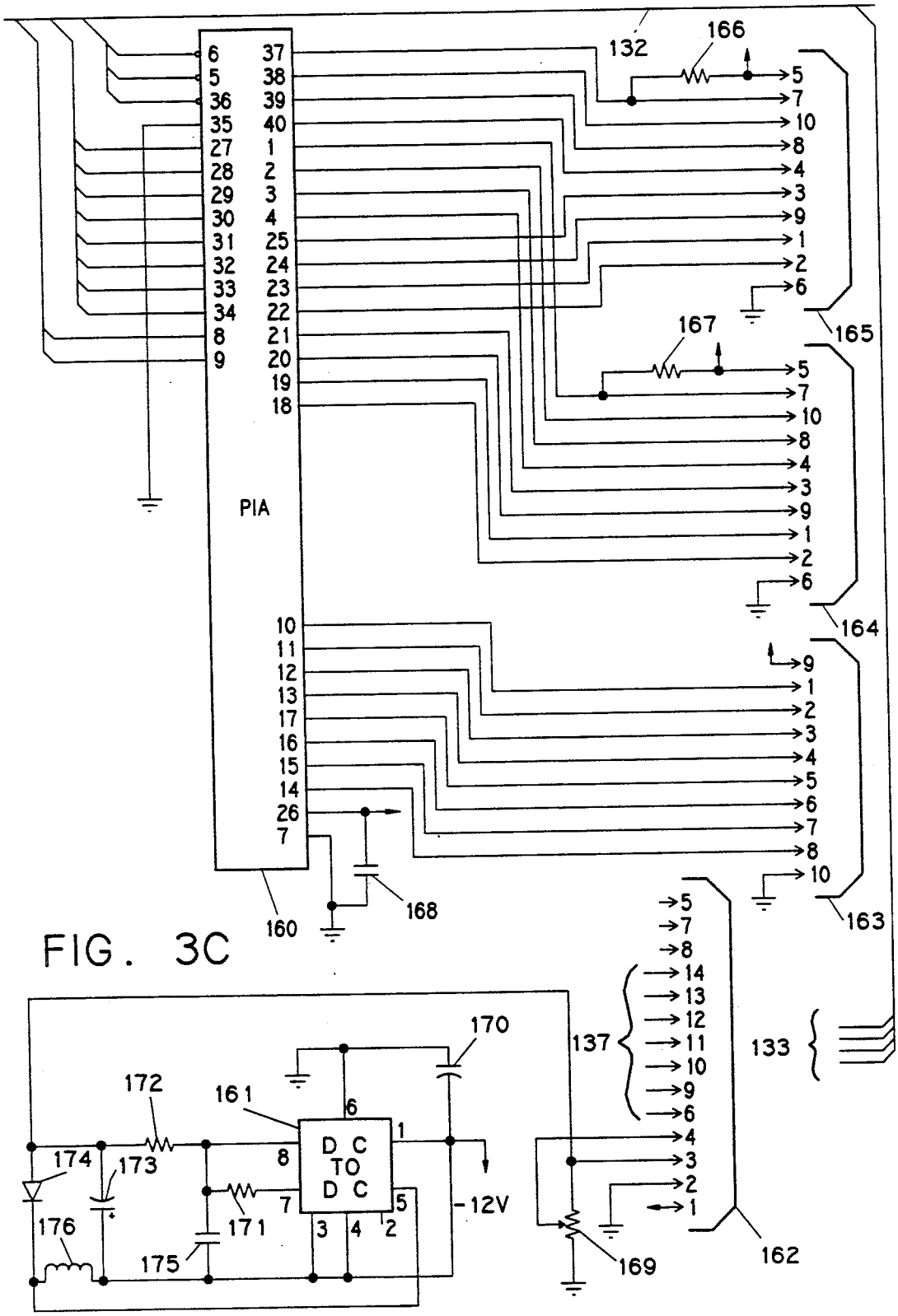
Figure 3D:
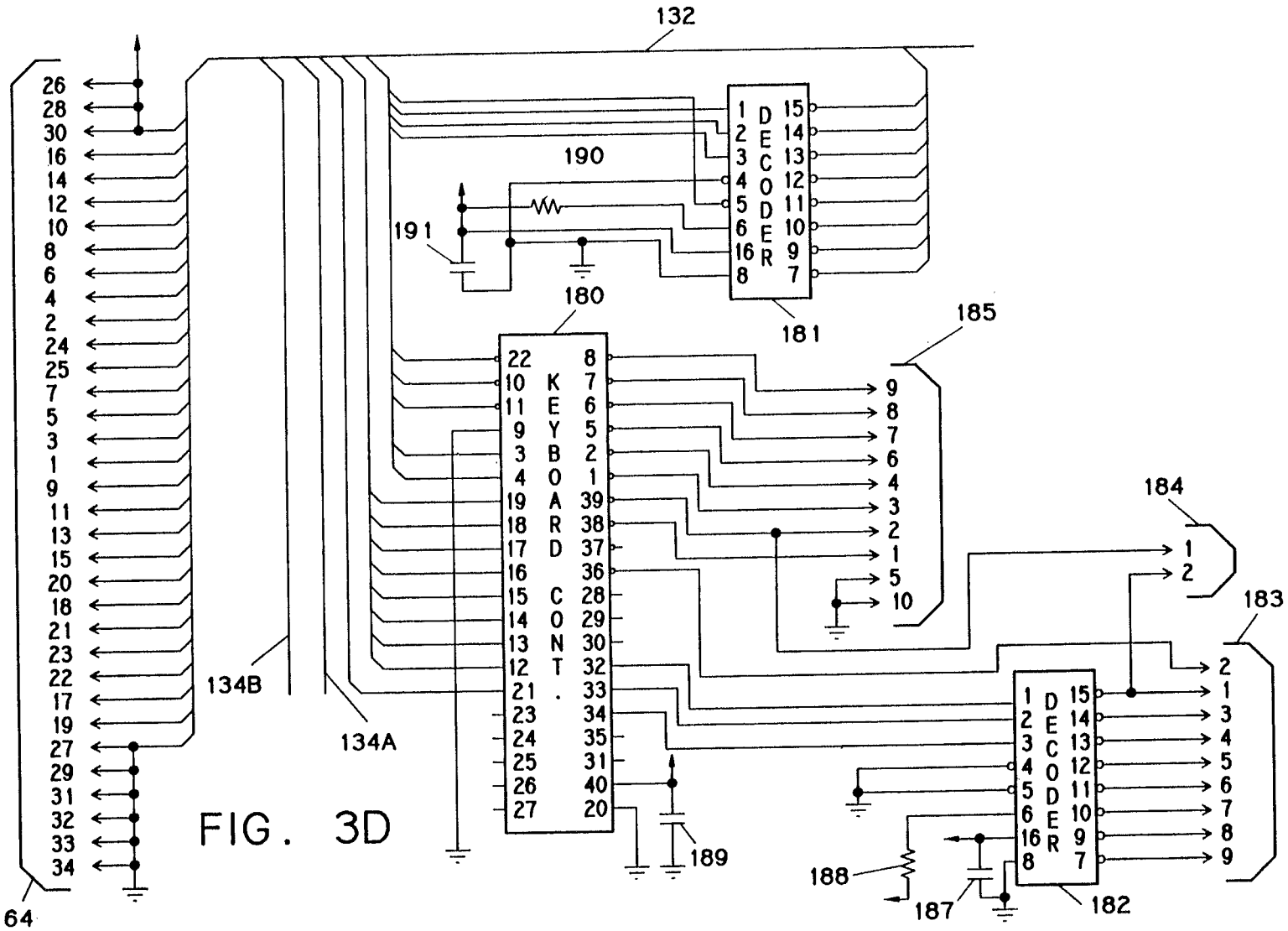
Figure 3E:
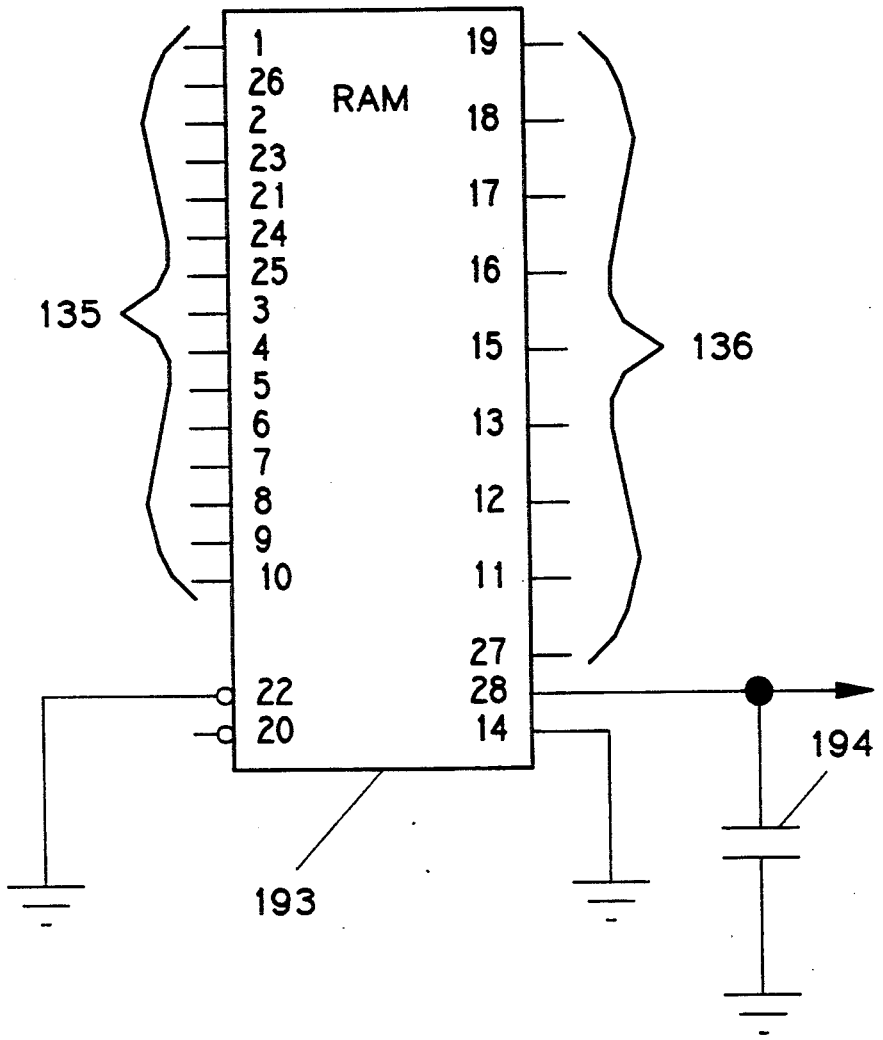
Figure 3F:
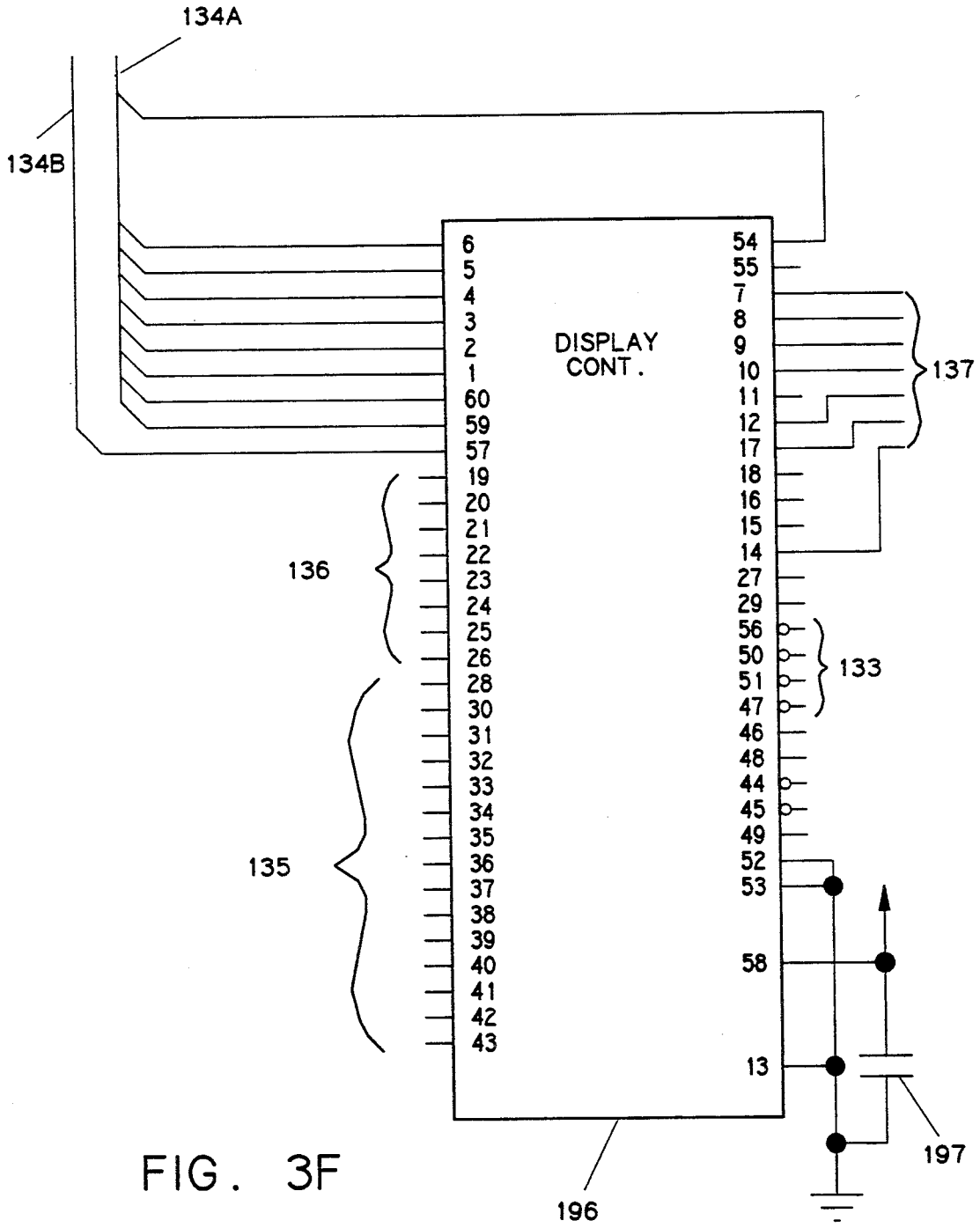
Figure 4C:
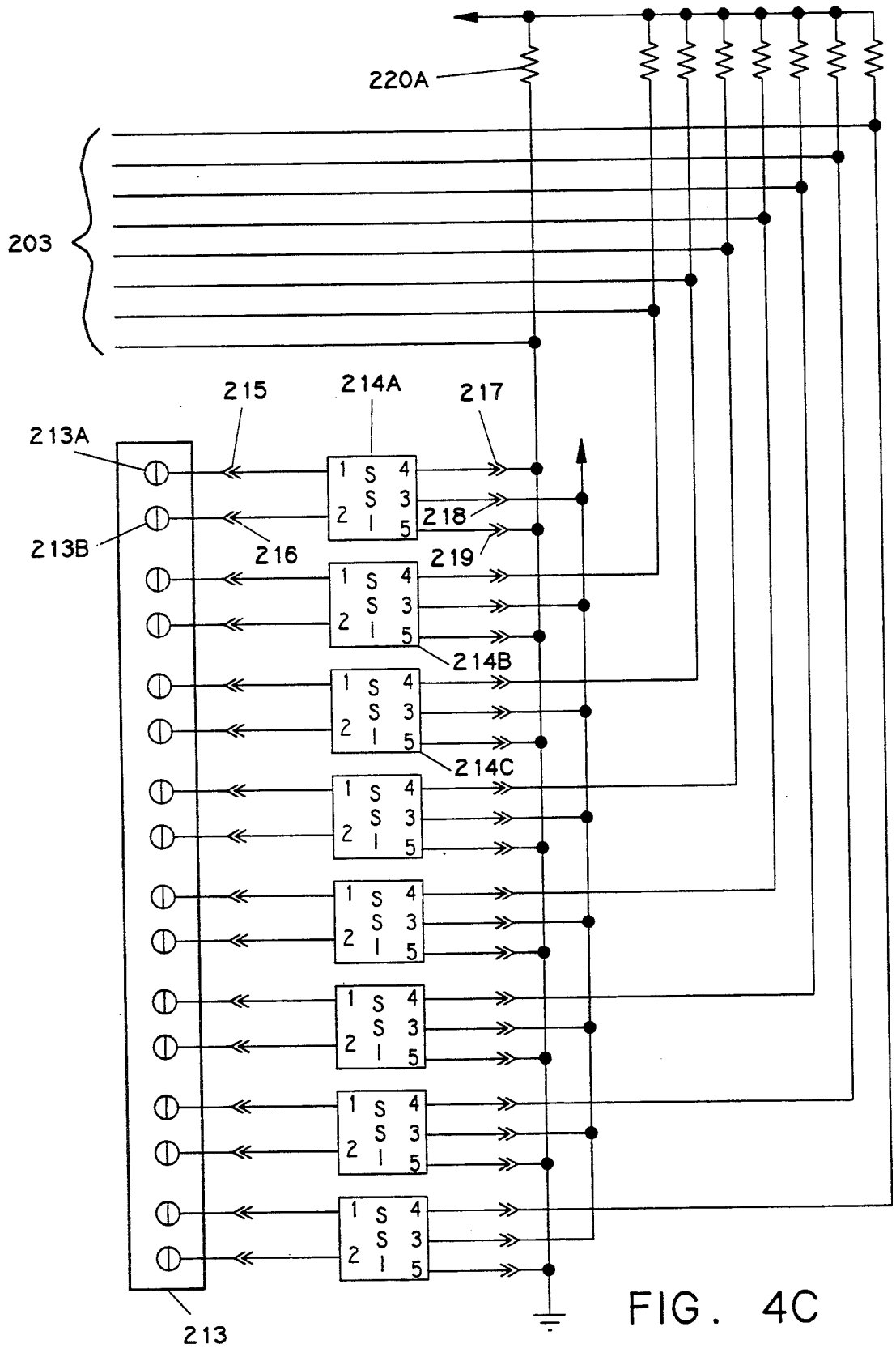
Figure 4D:
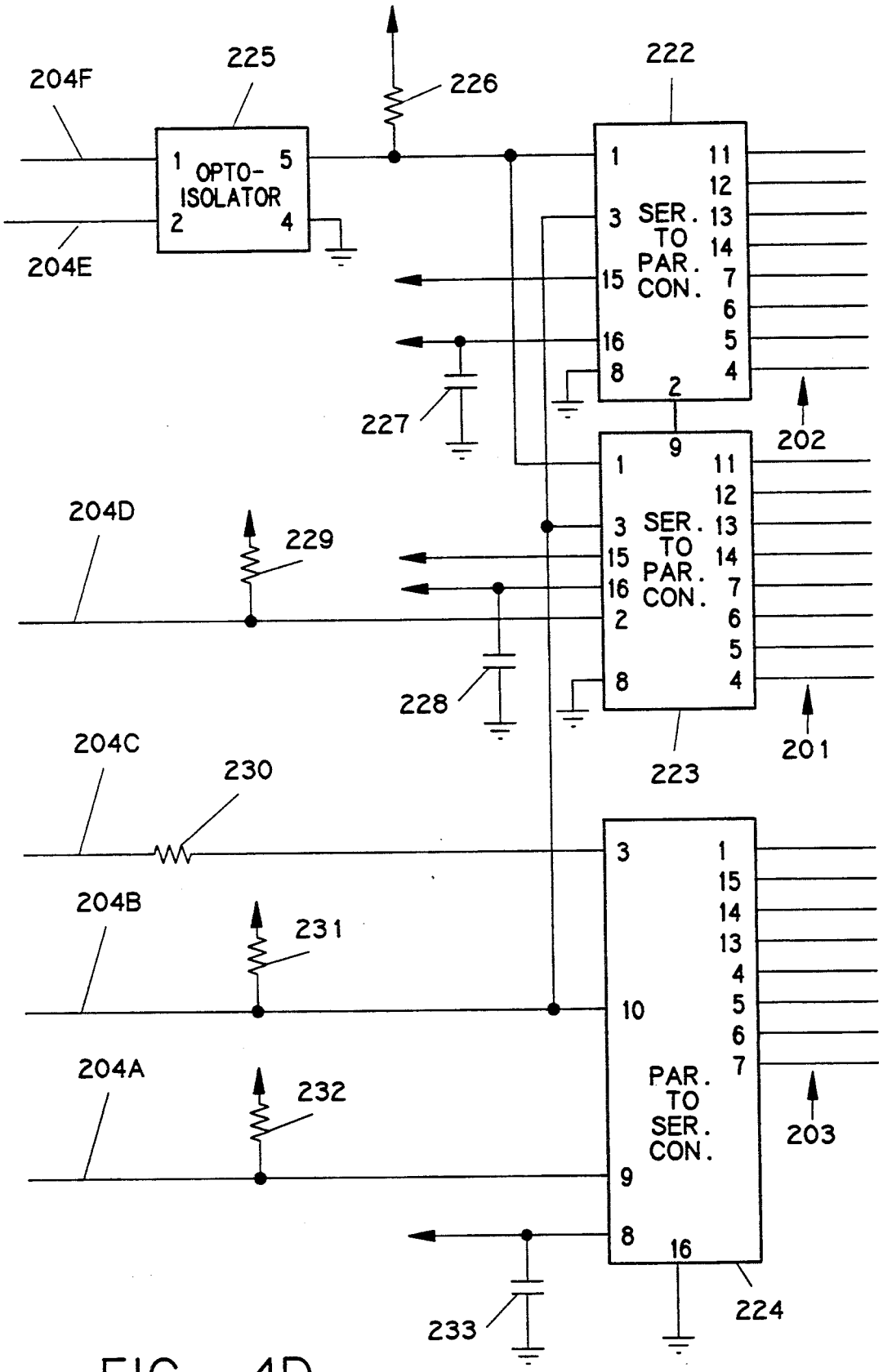
Figure 4E:
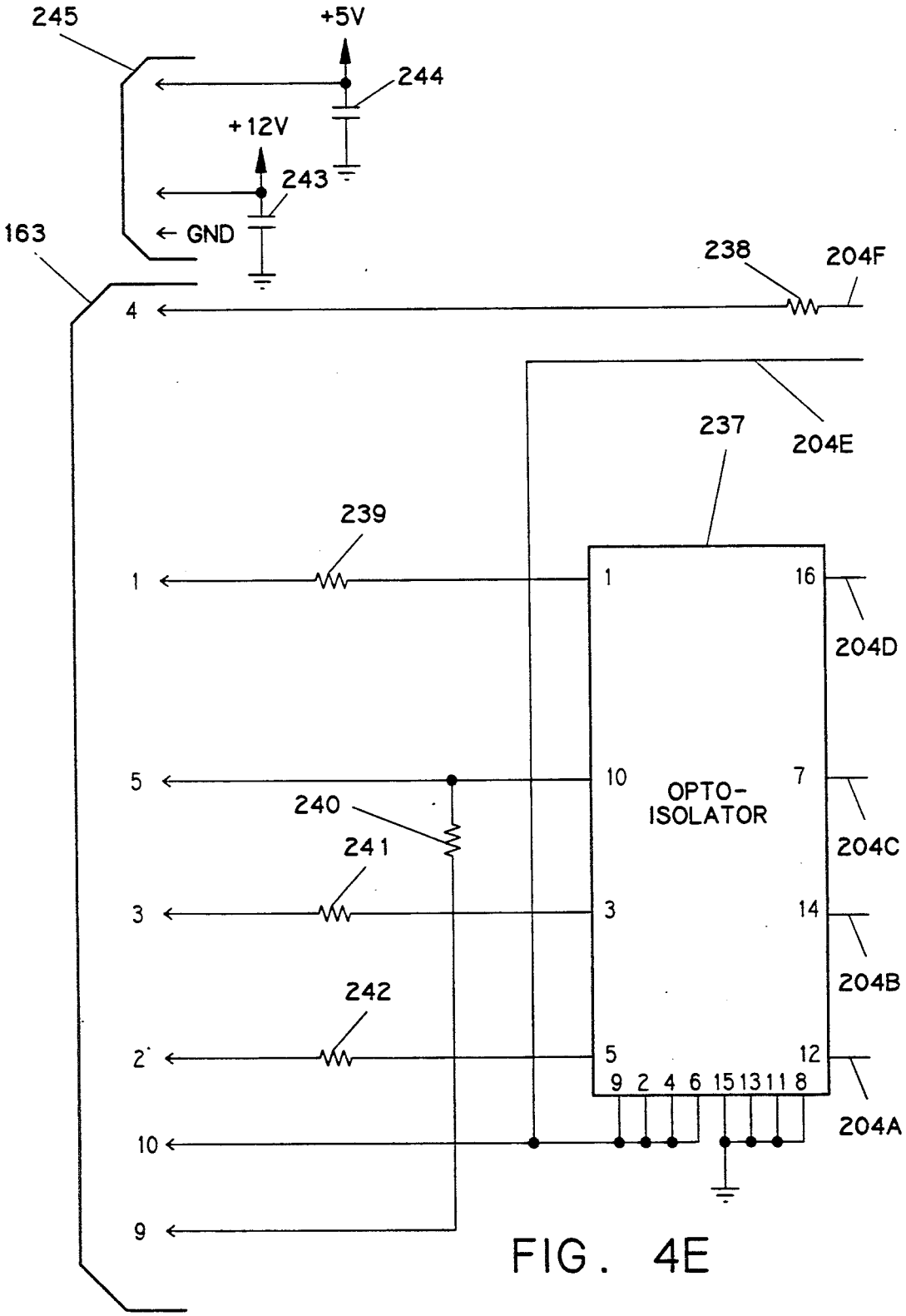
Figure 5:
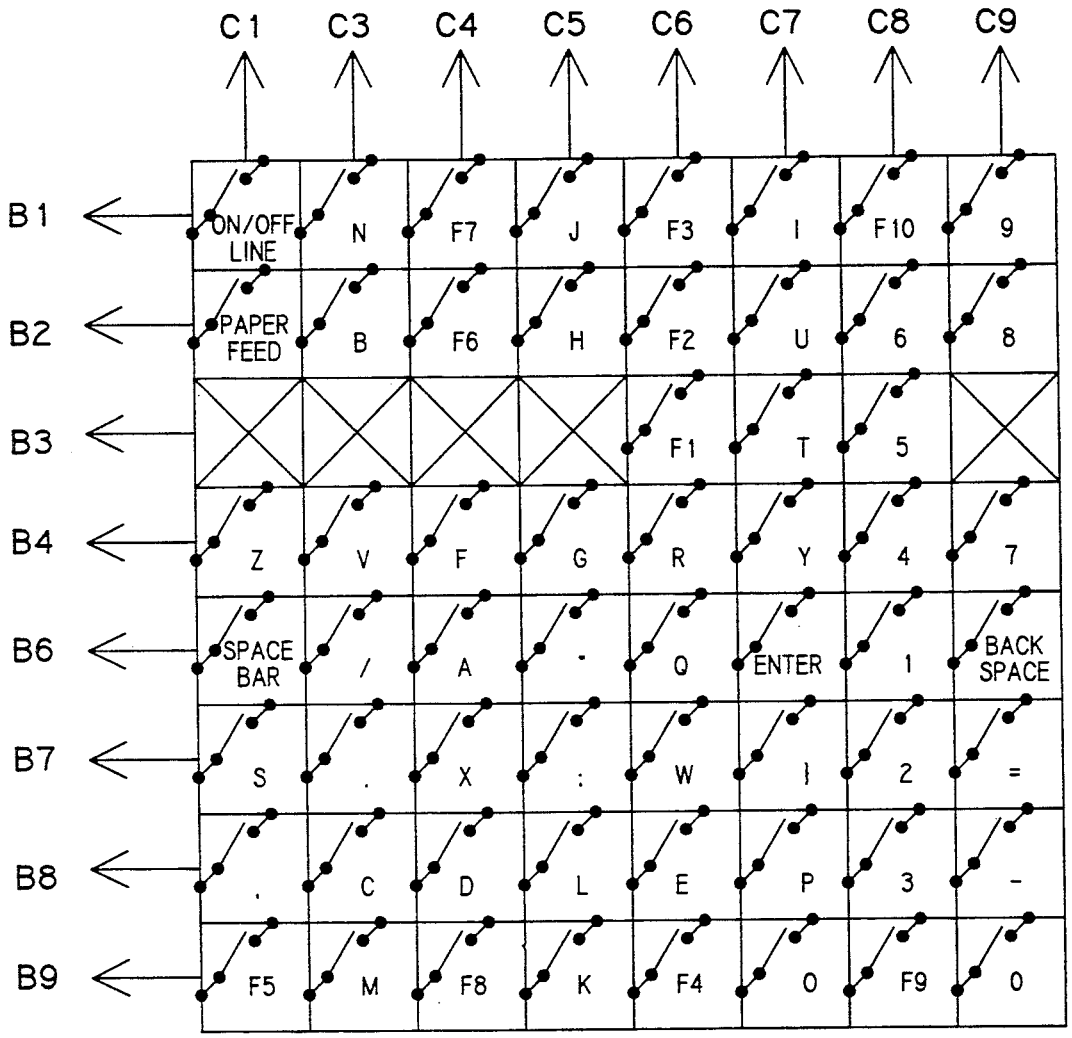
FIG. 5 shows the keyboard switch network truth table of the embodiment of FIG. 1.
Figure 5:
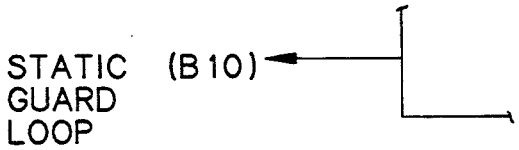
Figure 5:
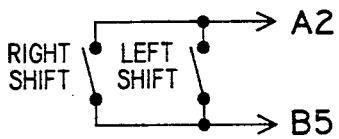

Turning now to a more detailed description of the invention, the preferred embodiment of the electronic circuit of the invention is shown in FIGS. 2A through 5. FIGS. 2A through 2H show the central processing unit circuit board, FIGS. 3A through 3F show the input-/output circuit board, FIGS. 4A through 4E show the relay/solid state input circuit board, and FIG. 5 shows the keyboard circuit. There is also an interface circuit between the controller and the probes, however this circuit is conventional and will therefore not be discussed in detail. Turning to FIGS. 2A through 2H, we shall first describe how these Figs. are interconnected, and then discuss the details of each. FIG. 2A is connected to FIG. 2B via cable 36, and is in turn connected to FIG. 2C via the same cable. If FIG. 2D is placed below FIG. 2C the connections of the two via cables 37A through 37F become clear. FIG. 2E connects to FIG. 2C via cable 36 and connects to FIG. 2F via cable 38A. A set of three electrical lines 39A and another set of three lines 39B as well as cable 40 are shown at both the left of FIG. 2E and the right of FIG. 2G making the connections between these two Figs. clear. FIG. 2G connects to FIG. 2F via lines 41 which connect to the left side of CPU 24, and also via the three lines 43A, 43B, and 43C. FIG. 2H connects to FIG. 2G via cable 44. FIG. 2H connects to FIG. 2F via lines 45A, 45B, 46A, 46B, 46C, 47 and 48.

Figure 2E:
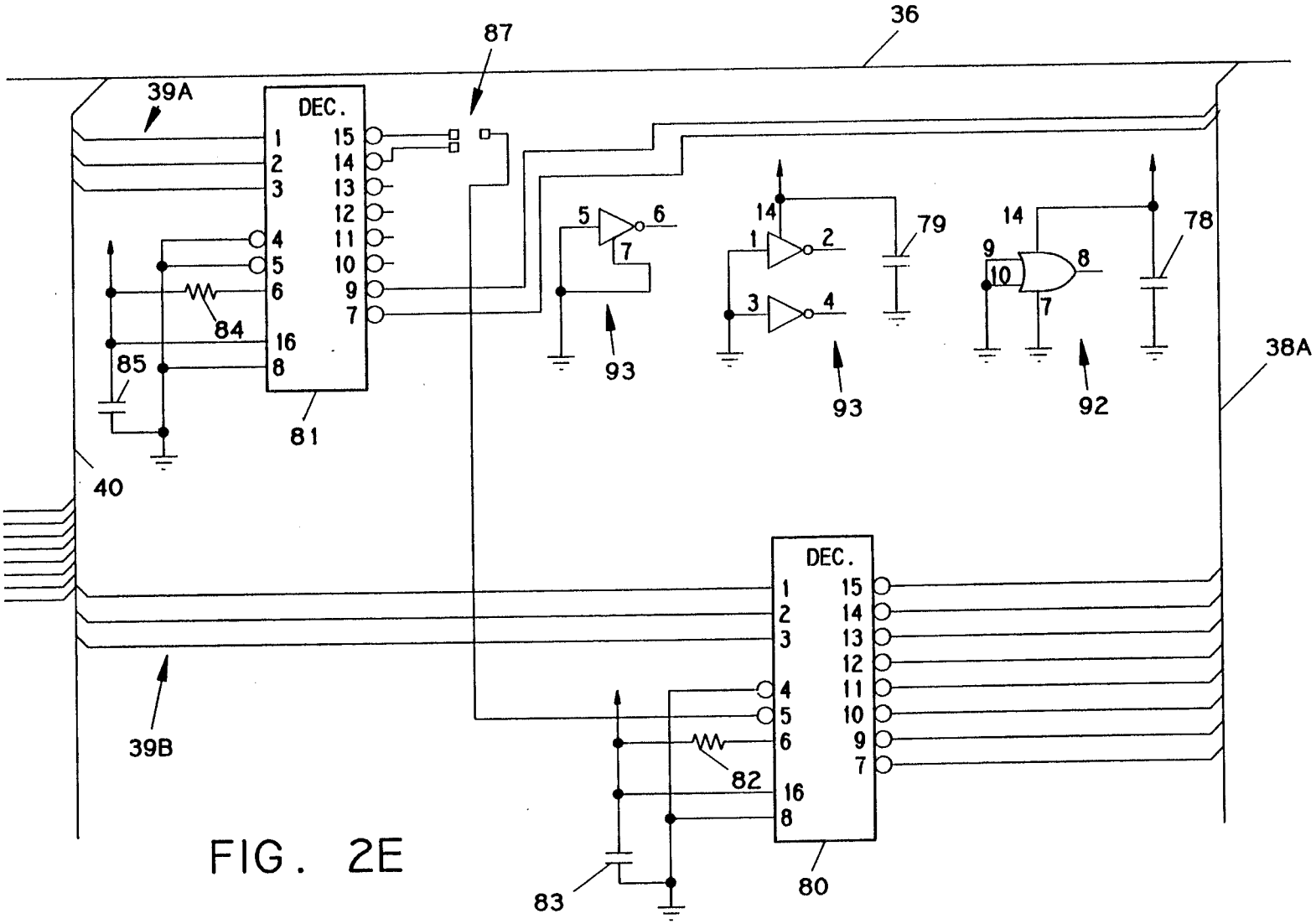
Figure 2F:
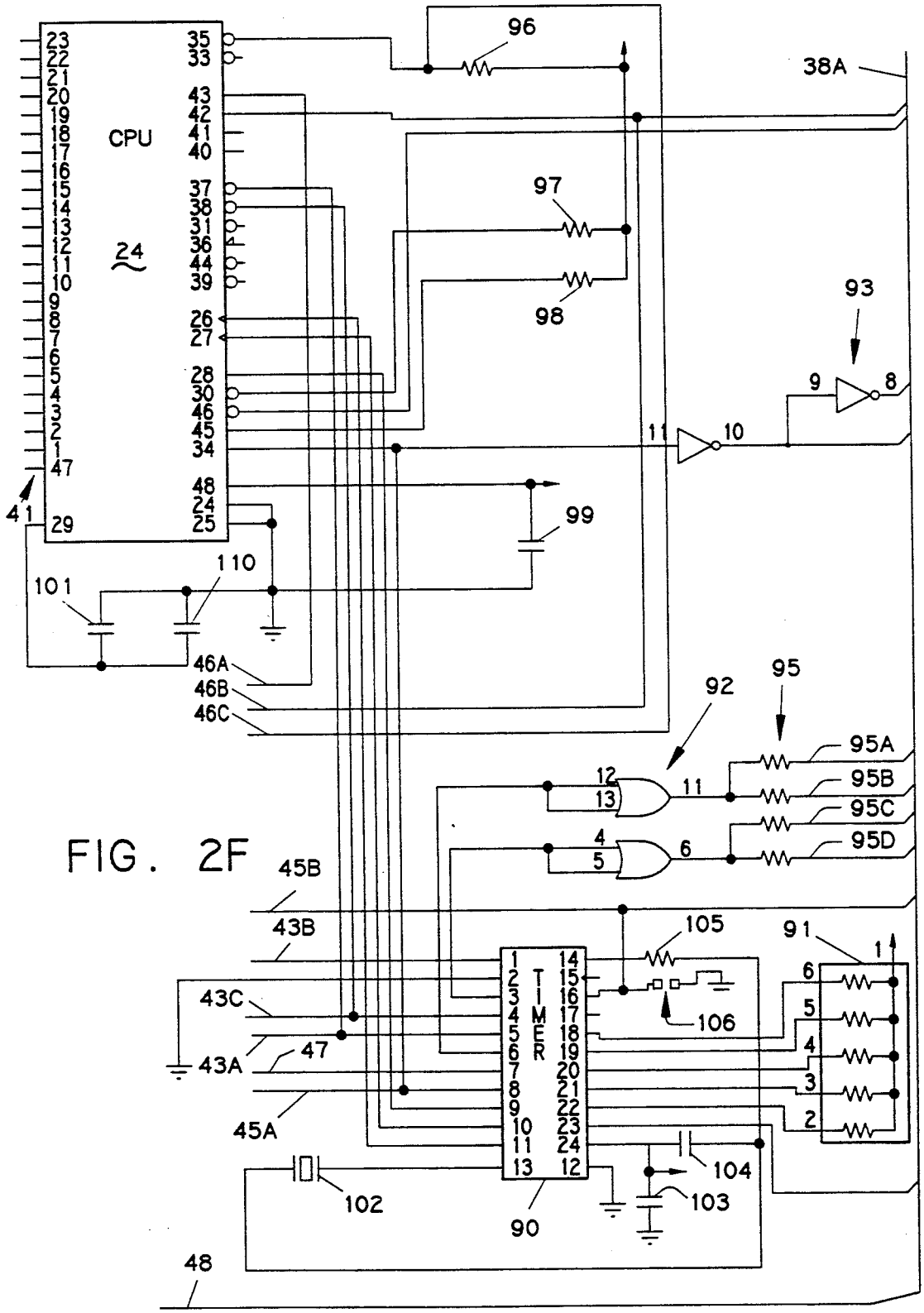
Figure 2G:
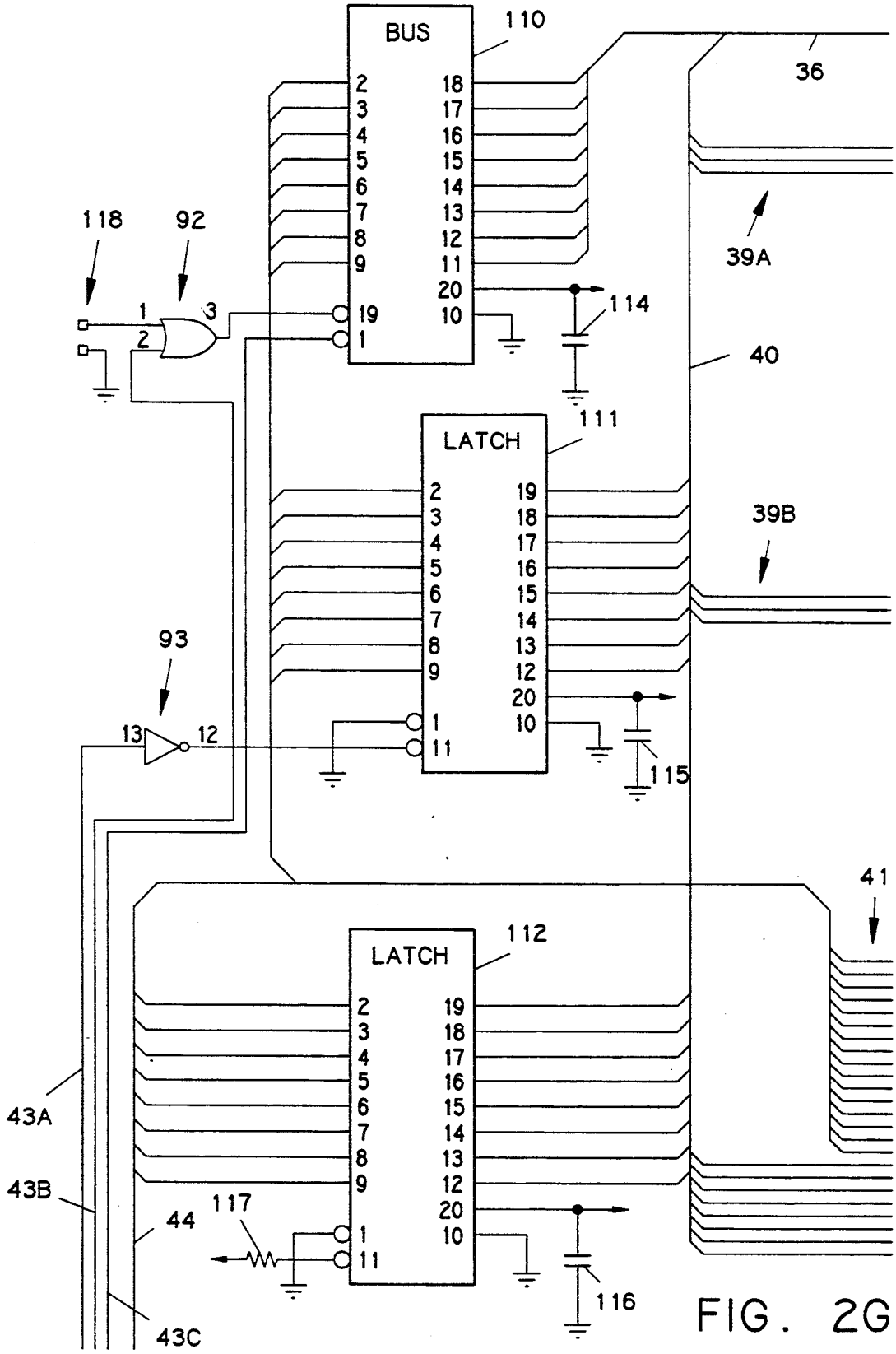
Figure 2H:
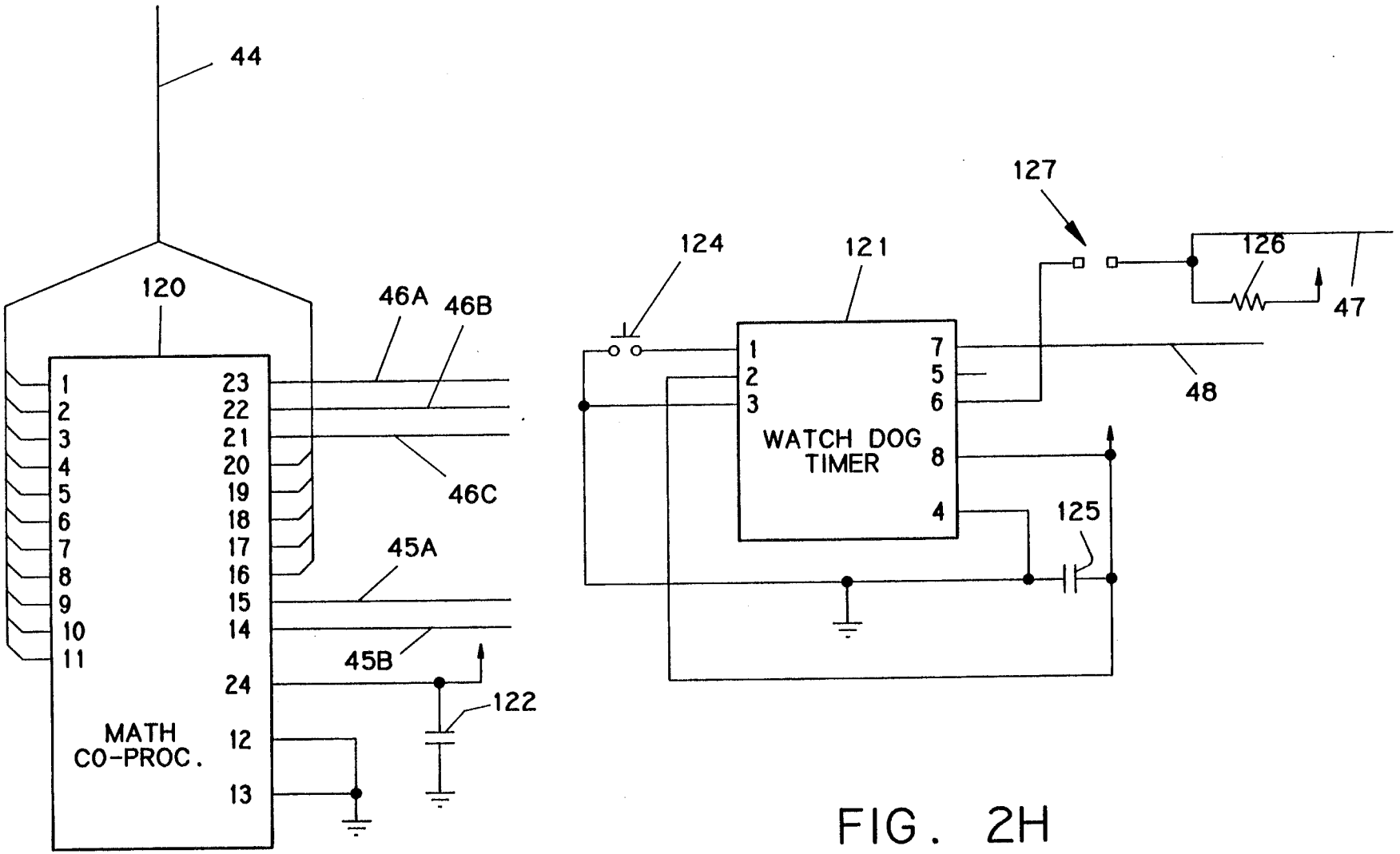

Turning now to the individual parts of the circuit mounted on or forming part of the CPU circuit board include: in FIG. 2A, four position dip switch 50, resistor block 51 with five 10 Kohm resistors, resistor block 52 with nine 10 Kohm resistors, PN2222 NPN transistors 53 and 54, terminals 55 and 56, type 32202 interrupt controller 57, 150 ohm resistors 58 and 59, 0.1 microfarad capacitor 60, and 10 Kohm resistor 61. Throughout the electrical circuits discussed herein, a ground symbol, such as at 62, denotes a connection to ground while an arrow, such as at 63 denotes a connection to the positive five volt power supply. In addition, each electrical circuit element, such as the interrupt controller 57, includes the pin numbers, such as pin number 40 shown at 57A. Each of these electrical circuit elements are conventional and readily attainable at most electrical supply sources, and each comes with literature describing it and its function in detail. Thus the details will not be discussed herein. When a circle, such as 57B, is shown at a pin number, it means the connection to the pin is inverted. The interrupt controller 57 provides interrupt, timer and counter functions for the CPU, the dip switch 50 clears the memory, the terminal 55 connects to the status LEDs such as 19 on the front of the case (FIG. 1), and the terminal 56 connects to the audio transducer 32. Turning to FIG. 2B, the circuit includes connector 64, 10 microfarad capacitor 65, and 10 Kohm resistors 66 and 67. Connector 65 connects to the input-/output circuit board (FIG. 3D). Continuing on to FIGS. 2C and 2D, the circuit includes type 27256 32 kilobyte EPROMs 70A through 70F, type 84256 32 kilobyte RAMs 73A and 73B. Each of the EPROMs 70A through 70F and the RAMs are connected to ground through a 0.1 microfarad capacitor such as 71. Turning to FIG. 2E, the electrical parts include type 74ALS138 3 line to 8 line decoders 80 and 81, 10 Kohm resistors 82 and 84, 0.1 microfarad capacitors 78, 79, 83, and 85, and jumper terminals 87. The elements 92 and 93 floating free in the central part of the figure represent unused portions of a quad OR chip 92 and a hex inverter chip 93, which will be discussed below, and are shown for schematic completeness. In FIG. 2F the electrical components are a type 32008 central processing unit 24 and a type 32201 timing and control chip which comes with the 32008 as part of a set, resistor block 91 with five 10 Kohm resistors, a quad OR gate chip 92 with four two-input OR gates, a hex inverter chip 93, four 47 ohm resistors 95, 10 Kohm resistors 96, 97, and 98, 0.1 microfarad capacitor 99, 0.001 microfarad capacitor 100, 1 microfarad capacitor 101, 20 MHZ oscillator 102, 0.1 microfarad capacitor 103, 30 picofarad capacitor 104, 470 ohm resistor 105, and jumper terminal 106. The electrical components in FIG. 2G include type 74ALS245 octal data bus transceiver 110, type 74ALS73 eight-bit latches 111 and 112, 0.1 microfarad capacitors 114, 115, and 116, 10 Kohm resistor 117, jumper terminal 118, and a gate from the each of the quad OR chip 92 and hex inverter chip 93. Turning to FIG. 2H, the components include type 32081 math co-processor 120, type DS1232 watch-dog timer and power supply monitor 121, 0.1 microfarad capacitors 122 and 125, switch 124, 10 Kohm resistor 126, and jumper terminal 127.

Turning now to FIGS. 3A through 3F the components and connections on the input/output printed circuit board are shown. The cables 130A, 130B, and 130C at the left of FIG. 3A connect to the cable 132 at the top left of FIG. 3B, which in turn connects into the top of FIG. 3C and goes on to FIG. 3D. Cables 134A and 134B connect FIG. 3D to FIG. 3F. Lines 133 in FIG. 3F connect to the lines 133 in FIG. 3C respectively from top to bottom, and similarly lines 137 in the two Figs. connect. Lines 135 and 136 in FIG. 3E connect respectively to the lines 135 and 136 in FIG. 3F. The components in FIG. 3A include type 88C681 Dual UART (Universal Asynchronous Receiver and Transmitter) 140, type LT1039 level converter 141, 3.6864 MHZ oscillator 142, 15 picofarad capacitor 143, 5 picofarad capacitor 144, 0.1 microfarad capacitor 145, 10 Kohm resistors 146 and 148, 220 ohm resistor 147, and connectors 150 and 151. Connector 151 connects to an inventory management circuit board which will not be discussed in detail herein, while connector 150 connects to a standard RS-232 9-pin connector. The level converter 141 provides the signal levels necessary for the RS-232 port. The resistors, such as 149, are resistors that are internal to the LT1039 and are described in the instructions for that chip. The components shown in FIG. 3B include 10 microfarad capacitors 152, 153, and 154, connector terminals 155, 156, and 157, 0.1 microfarad capacitor 158, and type 8255A parallel interface adapter 159. Terminal 155 connects to the controller power supply, terminal 156 connects to the LCD backlight, and the −12 V, +12 V and +5 V outputs provide the board power. Connector 157 connects to the printer controller. FIG. 3C includes the following components: type 8255A parallel interface adapter 160, D.C. to D.C. converter 161, connectors 162, 163, 164, and 165, 10 Kohm resistors 166, and 167, 0.1 microfarad capacitor 168, 10 kohm variable resistor 169, 10 microfarad capacitor 170, 13 Kohm resistor 171, 97.6K ohm resistor 172, 100 microfarad capacitor 173, 330 Henry inductance 176, type 1N4001 diode 174, and 0.1 microfarad capacitor 175. Connector 163 connects to the relay/solid state input board (FIG. 4E), and connectors 164 and 165 connect to the RA probe interface. The D.C. to D.C. converter 161 provides a 21 volt bias power for the display 18. FIG. 3D includes type 8279 keyboard controller 180, type 74LST138 three to eight line decoders 181 and 182, connectors 64, 183, 184, and 185, 0.1 microfarad capacitors 187, 189, and 191, and 10 kohm resistors 188 and 190. Connectors 183, 184, and 185 connect to the keyboard, paper feed switch and keyboard respectively. FIG. 3E shows a type 84256 RAM 193, and 0.1 microfarad capacitor 194, while FIG. 3F shows a type E1330 display controller 196, and 0.1 microfarad capacitor 197.

Turning to FIGS. 4A through 4E the components of the relay/solid state input board are shown. FIG. **4*a* connects to FIG. 4B via line 200 and to FIG. 4D via lines 201. FIG. 4B connects to FIG. 4D via lines 202; FIG. 4C connects to FIG. 4D via lines 203. If FIG. 4D is placed to the right of FIG. 4E, the connections of the two Figs. via lines 204A through 204F is clear. Considering FIGS. 4A and 4B together, they each show a type ULN2803A driver 206 and 209 respectively, a field wiring connector 207 and 210 respectively, and a series of eight relays 208 and 211 respectively. The drivers 206 and 209 driver the current for the relay coils. FIG. 4C shows a field wiring connector for the solid state input connections and a series of eight solid state input modules, such as 214A and 214B. For each of the modules, such as 214A, the board has five sockets 215, 216, 217, 218, and 219, into which the pins of the module are pushed. The Fig. also includes eight 10 kohm resistors, such as 220A. The solid state input modules, such as 214A, are field installable. Either an A.C. or a D.C. module may be inserted in each location, depending on whether an A.C. or D.C. device is to be connected to the input on connector 213. If a D.C. device is to be installed, then the preferred module is a Grayhill 70M-IDC5 module, such as 214A, if an A.C. device having the commonly available 110 volts power is to be installed, then the preferred module is a Grayhill 70M-IAC5 module, such as 214B, and if an A.C. device having the commonly available 220 volts power is to be installed, then the preferred module is a Grayhill 70M-IAC5-A, such as 214C. Turning to FIG. 4D, chips 222 and 223 are each type CD4094BC and together form a serial to 16 lines of parallel converter. FIG. 4D also includes a type CD4021BC parallel to serial converter 224, a single optoisolator 225, 4.7 Kohm resistor 226, 0.1 microfarad capacitors 227, 228, and 233, and 1 Kohm resistors 229 through 232. Converter 224 converts the parallel inputs to a serial mode for the microprocessor, while converter 222, 223 converts the serial microprocessor data to parallel to drive the relays. The electrical components shown in FIG. 4E include a type PS2502-04 quad opto-isolator 237, 1 Kohm resistors 238 through 242, 10 microfarad capacitors 243 and 244, and connectors 163 and 245. The opto-isolator prevents noise from the relays from getting back to the logic on the input/output board. Connector 245** connects to the controller power supply and provides the +5 and +12 power sources for the board.

The connections of the various components should be clear from the drawings and the instructions that come with each component when they are purchased. To specifically identify the connections the signals on each line, where not obvious from the drawing, are as follows. On the interrupt controller 57 the number 21, 30, 31, 32, 27, 3, 2, 12–19, 26, 25, 24, 23, 22, 33–39, 1, 28, and 4–11 pins are connected to the CS, RD, WR, CLK, RST, STI, INT, D7, D6, D5, D4, D3, D2, D1, D0, A4, A8, A2, A1, A0, IR1, IR3, IR7, IR7, IR9, IR11, IR13, IR15, COUT, Q7–Q0 signals respectively. The 2–9 outputs of the resistor block 52 are connected to the INT8-INT1l signals respectively. The No. 16, 14, 12, 10, 8, 6, 4, 2, 24, 25, 7, 5, 8, 1, 9, 11, 13, 15, 20, 18, 21, 23, 22, 17, and 19 pins of connector 64 are connected to the D8, D4, D5, D7, D2, D1, D0, INT1, CLKO, A20, A0, A1, A2, A8, A10, A9, CLK, CS6, INT3, RST-, INT2, RST, WR1, AND RD1 signals respectively. EPROM 70A has its No. 27, 26, 2, 23, 21, 24, 25, 3–10, 22, 20, 00–07 pins are connected to the A14–A0, RD, CS01, D0–D7 signals respectively. Each of the other EPROMs and RAMs in FIGS. 2C and 2D, such as 73A, are connected identically except that the No. 1 and the No. 27 pins of each RAM are connected to the A14 signal and the WR signal respectively, each of the No. 20 pins of EPROMS 70B through 70F and the RAMs 73A and 73B are connected to the CS01 through CS07 signals respectively. The 1–3, 9, and 7 pins of decoder 81 are connected to the A0-A2, CS6 and CS7 signals respectively. The 1–3 pins of decoder 80 are connected to the A15–A17 signals and it 15-7 pins are connected to the CS00–CS07 signals respectively. The 23-1 and 47 pins of CPU 24 are connected to the AD0–AD15 and A16–A23 signals respectively, while the 42 and 46 pins are connected to the ST1 and INT signals respectively. Pins 8 and 10 of hex inverter 93 are connected to the RST- and RST signals respectively. Lines 95A–95D (FIG. 2F) are connected to the WR1, WR, RD1, and RD signals respectively. The No. 7 pin of watch dog timer 121 is connected the KEEP ALIVE signal which also connects to the No. 8 pin of interrupt controller 57. The No. 14 pin of math coprocessor 120 is connected to the CLK signal, its No. 15–20 pins are connected to the RST- and the AD15–AD11 signals, and its NO. 1–11 pins are connected to the AD10–AD0 signals. The No. 2–9 pins of latch 112 are connected to the AD15–AD8 signals, while its 12–19 pins are connected to the A8–A15 signals respectively. The No. 2–9 pins of latch 111 are connected to the AD0–AD7 signals, while its 12–19 pins are connected to the A7–A0 signals. The 2–9 pins of bus 110 are connected to the AD0–AD7 signals, while its 11–18 pins are connected to the D7–D0 signals. Turning to FIGS. 3A through 3F, the 1–4, 19, 10, 18, 11, 17, 12, 16, 13, 25, 15, 5, 6, and 26 pins of UART 140n are connected to the A0–A3, D0–D7, RST, INT2, WR1, RD1, and CS62 signals respectively. The 9, 8, 34–27, 35, 36, 5, and 6 pins of PIA 159 are connected to the A0, A1, D0–D7, WR1, RD1, and CS63 signals respectively, while its No. 14 pin is connected to the INT3 signal. The 38–40 pins of PIA 160 are connected to the OIL, WET, and DRY signals on RA interface connector 165, its 2, 3, and 4 pins are connected to the OIL, WET, and DRY signals respectively on RA interface connector 164, its 25–22 pins are connected to the RA3–RA0 signals on connector 165, its 21–18 pins are connected to the RA3–RA0 signals on connector 164, and its 10, 11, 12, 13, and 17 pins are connected to the DATA 0, LATCH I, CLK, LATCH 0, AND DATA I signals respectively on connector 163. The pins on the left side of PIA 160 are connected to the same signals as the corresponding pins on PIA 159. The 10, 12–15 pins of decoder 181 are connected to the CS65, and CS63–CS60 signals respectively, while its 1, 2, 3, and 5, pins are connected to the A10, A19, A20, and CS6 signals respectively. The 21, 12–19, 4, 3, 9, 11, 10, and 22 pins of keyboard controller 180 are connected to the A0, D0–D7, INTl1 CLK0, WR1, RD1, And CS61 signals respectively. The No. 54 pin of display controller 196 is connected to the CLK signal, its 57, 59, 60, and 1–6 pins are connected to the A0, and D0–D7 signals respectively, while its 47, 51, 50, and 56 pins are connected to the RST-, WR1, RD1, and CS60 signals. On the relay/SSI board in FIG. 4E, the No. 1, 10, 3, and 5, pins of opto-isolator 237 are connected to the DATA 0, DATA I, CLK, and LATCH I signals respectively of connector 163, while the resistor 238 is connected to the LATCH 0 signal on the connector. As is conventional nomenclature in such electrical schematics, all pins connected to the same signal are connected to each other. All connections other than those given above in terms of the signals should be clear from the drawings.

Turning now to FIG. 5, the truth table for the keyboard means 11 is shown. The keyboard means operates by the keyboard controller driving each one of the C1 through C9 lines along the top to a logic zero and examining the lines B1 through B9 along the left side to see the result. This tells the controller which key has been pressed. It should be noted that the function key switches 20 are integrated into the truth table with the other keys on keyboard 15. Each time a key is pressed, the system emits a short audible beep to indicate that the pressing of the key has been recognized.

Turning now to the function of the system, the system is first configured as described in U.S. Pat. No. 4,740,777. At the time of programming the probes and relays, the release conditions under which each individual relay will release are selected as follows. FIG. 7 shows a preferred embodiment of the display for assigning relays to the probe being configured during the programming mode. The information on the configuration of the particular probe is given at the top part of the screen. The bottom half of the screen is the relay menu. Under the words "RELAYS ATTACHED" the number of relays available is given, which is eleven for the particular probe shown. Under the number of relays available, a row of numbers representing each available relay is given. At the left, the available alarm types are given, which for this probe are "FAIL" and "LEAK". Using the function keys F1 through F4 a flashing cursor may be moved up, down, left and right respectively on the screen. A relay is attached by moving a flashing cursor to the desired position corresponding to the relay number and the available alarm. Then using the toggle, i.e. key F5, increments the alarm state among the following possible states: blank for the relay unattached, D for the relay attached but the alarm disabled, and E for the relay attached and the alarm enabled. If the relay is attached, simultaneously and an A, B, or C will appear at the corresponding position under "RELEASE CONDITION". The cursor may then be moved to the positions under "RELEASE CONDITION" and the F5 key used to toggle between the A,B, or C release condition. As indicated at the bottom of the screen, A selects the release condition that the alarm must be acknowledged to be deactivated, B selects the condition that both the alarm must be acknowledged and event clear, and C the condition that the event must be cleared. When the release conditions have been set, the F10 key is pushed and the screen is returned to the probe configuration menu. After the system is configured and programmed as described above it may be placed in an operating mode in which it monitors the probes 14 and devices which may be attached to connector 213. When one or more signals are received by the controller corresponds to one or more alarm conditions, one or more alarm flags are set by the system software as is described in the above referenced patents, and an alarm is displayed as shown, for example, in FIG. 8. When the alarm is noticed by an operator, it may be acknowledged by entering a code, so that only authorized persons may acknowledge and alarm, then pressing the F4 key. This sets an alarm acknowledged flag for that alarm. Once the alarm is acknowledged, the F4 key is no longer defined on the alarm screen display.

During the monitoring program the system goes into subprogram to automatically releases the relays. The preferred embodiment of such a program is shown in FIG. 6. In this embodiment, the system has been programmed with four release conditions, one more than the three, A, B, and C, discussed in the above paragraph discussing the programming of the release conditions. We present these two different embodiments to provide a more thorough understanding of the different possibilities available. The extension of the above programming to this embodiment should be clear, as it simply requires a fourth iteration in the toggle sequence. The release conditions are:

Case 1: Deactivate when the event that caused the alarm occurs;

Case 2: Deactivate when the user has acknowledged the alarm.

Case 3: Deactivate when both the event has cleared and the alarm has been acknowledged;

Case 4: Deactivate when either the event has cleared or the alarm has been acknowledged.

Upon entering the subprogram, the system determines if the alarm is active now and was not active on the last pass. (Here "active" means that the event is not clear). If so, the appropriate relays as stored in memory 70 are activated. The system then delays for a brief time, then returns to the start of the subprogram. On this pass the subprogram passes out the "NO" branch of the first decision tree since the alarm was active on the last pass. If the alarm is still active, control passes to the "Has the alarm been acknowledged" decision tree. If the alarm has not been acknowledged, none of the four release conditions can be met, and the system delays then returns to the top of the loop. If the alarm has been acknowledged, the system asks if the system has been programmed for the second case. If so, it deactivates the appropriate relays, delays and returns to the top of the loop. If not it delays and returns. If the alarm is not active, that is it has cleared, on the second or subsequent pass, the system checks to see if the relay is programmed for case 1 or case 4. If so, then the appropriate relays are deactivated. If not, the system must be programmed for case 2 or 3. The system then checks to see if the alarm has been acknowledged. If the alarm has been acknowledged, then we have the case 3 situation and the appropriate relays are deactivated and the system delays and reloops. If the alarm has not been acknowledged, then neither case two or case 3 can be valid, and the system delays and reloops. During the delay period, the control of the system is passed to a taskmaster program, which is a program which manages the many functions of the system. The system returns to this subprogram only if there is an active alarm.

There has been described a fluid detection system that provides for preselecting of the conditions under which a relay will be released, and automatic release when the conditions are met, and has numerous other features and advantages. It is evident that those skilled in the art may now make numerous uses and modifications of the specific embodiments described, without departing from the inventive concepts. For example, other release conditions may be used and other devices other than relays may be set and released. Or other subprograms may be designed. Or the invention may be used in combination with other functions. Or the system may be made with a wide variety of different electronic parts. Consequently, the invention is to be construed as embracing each and every novel feature and novel combination of features present in and/or possessed by the fluid detection system described.

What is claimed is:

1. A fluid status detection system comprising a controller and a plurality of probes for sensing the status of fluids at probe locations remote from the controller, each of said probes including means for providing a probe signal to said controller indicative of the fluid status at the probe location, said controller including:

alarm means for providing an alarm;

relay means;

activation means responsive to said probe signals for activating said alarm means and latching said relay means;

alarm acknowledgement means for permitting an operator to acknowledge an alarm and for providing an alarm acknowledgement signal upon said alarm being acknowledged;

storage means for storing relay release conditions;

selecting means for permitting an operator to select one or more release conditions from a plurality of possible release conditions and to store said conditions in said means for storing;

release means responsive to said probe signals and said alarm acknowledgment signal and communicating with said means for storing for releasing said relay means upon receiving one or more signals corresponding to one or more of the stored relay release conditions.

2. A fluid status detection system as in claim 1 wherein said plurality of possible release conditions comprise: the condition that the probe signal indicates that the event that caused the alarm has cleared; and the condition that the alarm acknowledgment signal has been provided.

3. A fluid status detection system as in claim 2 wherein said plurality of possible release conditions further include that the probe signal indicates that the event that caused the alarm has cleared and that the alarm acknowledgment signal has been provided.

4. A fluid status detection system as in claim 1 wherein said relay means comprises a plurality of relays and said selecting means comprises means for individually selecting release conditions for each relay.

5. A fluid status detection system as in claim 1 wherein said release means includes a microprocessor and software means for causing said microprocessor to cycle through a loop checking whether a selected activation condition has been met and means for causing a delay for a predetermined time each time said loop is cycled.

6. A fluid status detection system as in claim 1 wherein said alarm acknowledgment means comprises a means for resetting said alarm.

* * * * *